US006127789A

United States Patent [19]

Ishizuka et al.

[11] Patent Number: 6,127,789

[45] Date of Patent: Oct. 3, 2000

[54] APPARATUS FOR CONTROLLING THE LIGHTING OF A DISCHARGE LAMP BY CONTROLLING THE INPUT POWER OF THE LAMP

[75] Inventors: Akio Ishizuka, Kanagawa-ken, Japan; Kiyoshi Minegishi, Saint-Die, France; Akihiro Ueda, Kanagawa-ken, Japan

[73] Assignee: Toshiba Lighting & Technology Corp., Tokyo, Japan

[21] Appl. No.: 09/070,156

[22] Filed: Apr. 30, 1998

[30] Foreign Application Priority Data

| | | | |
|---|---|---|---|
| Apr. 30, 1997 | [JP] | Japan | 9-113074 |
| May 30, 1997 | [JP] | Japan | 9-142621 |
| Jun. 30, 1997 | [JP] | Japan | 9-174980 |

[51] Int. Cl.[7] ..... G05F 1/00

[52] U.S. Cl. ..... 315/308; 315/291; 315/362; 315/128; 315/82; 315/DIG. 7

[58] Field of Search ..... 315/308, 307, 315/291, 360, 362, 247, 244, 224, 209 R, 128, 82, 77, DIG. 7

[56] References Cited

U.S. PATENT DOCUMENTS

| | | | |
|---|---|---|---|
| 5,151,631 | 9/1992 | Oda et al. | 315/127 |
| 5,572,094 | 11/1996 | Yamashita et al. | 315/308 |
| 5,589,742 | 12/1996 | Ueda | 315/307 |
| 5,880,563 | 3/1999 | Toyama et al. | 315/225 |

FOREIGN PATENT DOCUMENTS 6-20781 1/1994 Japan .

*Primary Examiner*—Haissa Philogene
*Attorney, Agent, or Firm*—Pillsbury, Madison & Sutro, LLP

[57] ABSTRACT

Provided is an apparatus for controlling the power supplied to a discharge lamp by detecting the voltage and current of the lamp's electric supply line. A microcomputer monitors power consumption of the discharge lamp by multiplying the voltage and current detected in the supple line to determine the input power and produces a representative control signal. The actual input power is compared with a preset input power, based upon the signal, and the power consumption of the discharge lamp is controlled in accordance with the results of the comparison.

21 Claims, 14 Drawing Sheets

APPARATUS FOR CONTROLLING THE LIGHTING OF A DISCHARGE LAMP BY CONTROLLING THE INPUT POWER OF THE LAMP

BACKGROUND OF THE INVENTION

1. Field of the Invention

The present invention relates to a discharge lamp lighting apparatus capable of maintaining the stabilized lighting of discharge lamps.

2. Description of the Related Art

FIG. 1 is a circuit diagram showing a conventional metal halide lamp lighting apparatus.

A lighting apparatus 500 shown in FIG. 1 lights a metal halide lamp 505 by supplying DC voltage that was obtained by the full-wave rectification and smoothing of AC voltage from an AC power source 501 to a load lamp starting circuit 504.

At this time, electric power to be supplied is regulated to a desired constant level by a choke coil 506 and a switching transistor 507 provided at the electric power supply line to the starting circuit 504.

That is, to regulate electric power to a constant level, a voltage value of the starting circuit 504 is first measured by dividing the terminal voltage of the starting circuit 504 by a load voltage detecting resistor 508 that is connected between both terminals of the starting circuit 504. Further, load current is obtained from the terminal voltage of a load current detecting resistor 509 provided at the minus terminal of the starting circuit 504. Then, from these voltage values of the starting circuit 504 and load current of the load current detecting resistor 509, present load consumption power is obtained by an electric power detecting circuit 511. This load power consumption is fed back to a PWM control IC 512. According to this fed back load consumption power, the base voltage of the switching transistor 507 is controlled by the PWM control IC 512. When its base voltage is controlled, the switching transistor 507 is switched so as to maintain the supply power to the metal halide lamp 505 at a constant level.

The electric power detecting circuit 511 secures the electric power using the choke coil as a transformer and the PWM control IC 512 also secures the electric power from the electric power supply line.

In computing electric power in the electric power detecting circuit 511, an analog multiplier is used but as accuracy of electric power computation is not sufficient, a constant electric power control is insufficient. So, it is desirable to compute electric power precisely using a microcomputer.

However, even when using an electric power detecting circuit employing a microcomputer instead of the electric power detecting circuit 511, there is such a problem as described below. That is, if an electric power detecting circuit using a microcomputer is connected to the secondary side of the choke coil 506 likewise the electric power detecting circuit 511 shown in FIG. 1, GND (Ground) of the microcomputer is not stabilized due to the switching operation of the switching transistor 507 and circulating current by the choke coil 506 and therefore, the operation of the microcomputer also is not stabilized.

So, it is desirable to control electric power supplied to the metal halide lamp 505 at a constant level by detecting voltage and current of the electric power supply line by connecting an electric power detecting circuit using a microcomputer to the AC power source 501 side of the electric power supply line from the switching transistor 507 and the choke coil 506.

For instance, to control the electric power at a constant level by detecting the power consumption of the metal halide lamp 505 by detecting the voltage and current of the electric power supply line without measuring the voltage of the metal halide lamp 505 as shown above, the voltage of the metal halide lamp 505 does not become constant and such a problem as shown below is produced.

That is, if equivalent resistance of the metal halide lamp 505 is low, abnormally large current flows to a load side and as a power loss is proportioned to a square of resistance value×current, the power loss tends to become extremely large. And the power loss is consumed in the switching transistor 507, diode 510, wiring, etc. highly heating them and such a deficiency as the functional stop or damage of elements will result.

On the contrary, if equivalent resistance of the metal halide lamp 505 is high, abnormally high voltage may be applied continuously. At this time, there will be such a problem that leak current will increase or safety will drop if an electric leakage is taken place.

Further, a technology to turn off a discharge lamp lighting circuit by detecting an abnormal state of a discharge lamp was disclosed in the Japanese Patent Publication of Unexamined Patent Application No. 6-20781. That is, threshold values of upper and lower limits for the lamp voltage of discharge lamps of cars are set and if a measured value of lamp voltage exceeds the upper limit threshold value or drops to below the lower limit threshold value after a prescribed time delay, such abnormal state that a discharge lamp is in the open state or in the shorted state is detected and based on the result of this detection, the discharge lamp lighting circuit is turn off.

However, lamp voltage of a high-pressure discharge lamp has such a character that the low voltage state continues for a while immediately after starting the lighting and thereafter, it rises to a rated lamp voltage. Because of such the character of the lamp voltage to vary in two steps, only by simply judging whether the lamp voltage falls below the lower limit threshold value as disclosed in the above mentioned Japanese Patent Publication of Unexamined Patent Application No. 6-20781, the abnormal state and the normal state of the lamp voltage cannot be fully discriminated. Therefore, there is a problem that an abnormal state of too low lamp voltage cannot be surely detected.

Further, for instance, in case of a fluorescent lamp, it was so far urged to exchange a lamp if the ends of a lamp tube are blackened or a lamp begins to flicker. Or, by setting an operating time of a lamp and conducting the maintenance work periodically, the lamp life was managed by exchanging a lamp before its service life was over.

However, a high-pressure discharge lamp has become widely in use by such business machines as OHP (Over Head Projector), projection TV, etc. in recent years.

So, if a high-pressure discharge lamp was burnt out, business and life are largely crippled and yet it is very troublesome to manage operating times of high-pressure discharge lamps and exchange them before their service lives are over. In addition, as no spare of expensive high-pressure discharge lamp is always reserved, such a problem comes out increasingly that business and lives are largely crippled as the life of high-pressure discharge lamp was suddenly exhausted.

Further, as slow leakage from a high-pressure discharge lamp is not easily detected, there is a problem that an abnormal state resulting from this slow leakage cannot be perceived.

In addition, if an interelectrode distance of a high-pressure discharge lamp is short, high lamp current flows continuously after lighting the lamp, heating the electrodes extremely and stress is accumulated in the sealed root portion of the electrodes and cracks may possibly be produced.

SUMMARY OF THE INVENTION

It is an object of the present invention to provide a discharge lamp lighting apparatus that does not cause such problems as fault, breakage, damage of circuit elements, etc. of a lamp when voltage of a discharge lamp becomes out of a proper value.

It is another object of the present invention to provide a discharge lamp lighting apparatus that is capable of surely turning off a discharge lamp by detecting an abnormal state where lamp voltage of a discharge lamp is too low or too high.

It is a further object of the present invention to provide a discharge lamp lighting apparatus that is capable of detecting generation of trouble resulting from the exhausted life of a lamp and/or slow leakage.

According to the present invention, a discharge lamp lighting apparatus is provided. This discharge lamp lighting apparatus is composed a power source to supply an electric power to a discharge lamp via a supply line, switching means for turning on/off the current flowing through the supply line;

PWM control means for PWM controlling the electric power by controlling the on/off timing of the switching means, line voltage detecting means for detecting a line voltage generated on the supply line, line current detecting means for detecting a line current flowing through the supply line, electric power detecting means for obtaining the input power to the discharge lamp based on the detected values of the line voltage and line current, constant power control means for controlling the supply power to the discharge lamp at a constant level by controlling the PWM controlling means based on the detected value of input power and the ON time ratio (duty ratio) of the switching means that was preset, lamp voltage detecting means for obtaining the voltage of the discharge lamp according to an equation (1) shown below based on the detected value of the supply line voltage, and turning off means for turning off the discharge lamp if a time when the obtained voltage value was out of a reset fixed value or a fixed range continued for a fixed time, Discharge lamp voltage=Supply line voltage value×ON time ratio (duty ratio) of pulse current supplied to the discharge lamp by PWM control (1)

Further, according to the present invention, a discharge lamp lighting apparatus is provided. This discharge lamp lighting apparatus is composed of a discharge lamp, a lighting circuit to light the discharge lamp, a voltage sensor to detect the lamp voltage of the discharge lamp, first comparing means for comparing the lamp voltage detected by the voltage sensor with a first threshold value lower than a prescribed rated voltage of the discharge lamp and a second threshold value that is further lower than the first threshold value, first stopping means for putting out the lighting circuit when the comparison by the first comparing means revealed that the lamp voltage became below the second threshold value, first clocking means for counting a continued time when the comparison by the first comparing means revealed that the lamp voltage became a value between the first and the second threshold values, and second stopping means for putting out the lighting circuit when the continued time counted by the first clocking means elapsed a prescribed period of time.

Further, according to the present invention, a discharge lamp lighting apparatus is provided. This discharge lamp lighting apparatus is composed of initial lamp voltage storage means for storing an initial lamp voltage when a discharge lamp is initially lighted, voltage detecting means for detecting the lamp voltage while the discharge lamp is on, voltage comparing means for comparing the lamp voltage detected by the voltage detecting means with the initial lamp voltage stored in the initial lamp voltage storage means, and lamp life detecting means for detecting the life of a discharge lamp based on the result of comparison by the voltage comparing means.

DETAILED DESCRIPTION OF THE PREFERRED EMBODIMENTS

Figure 1:
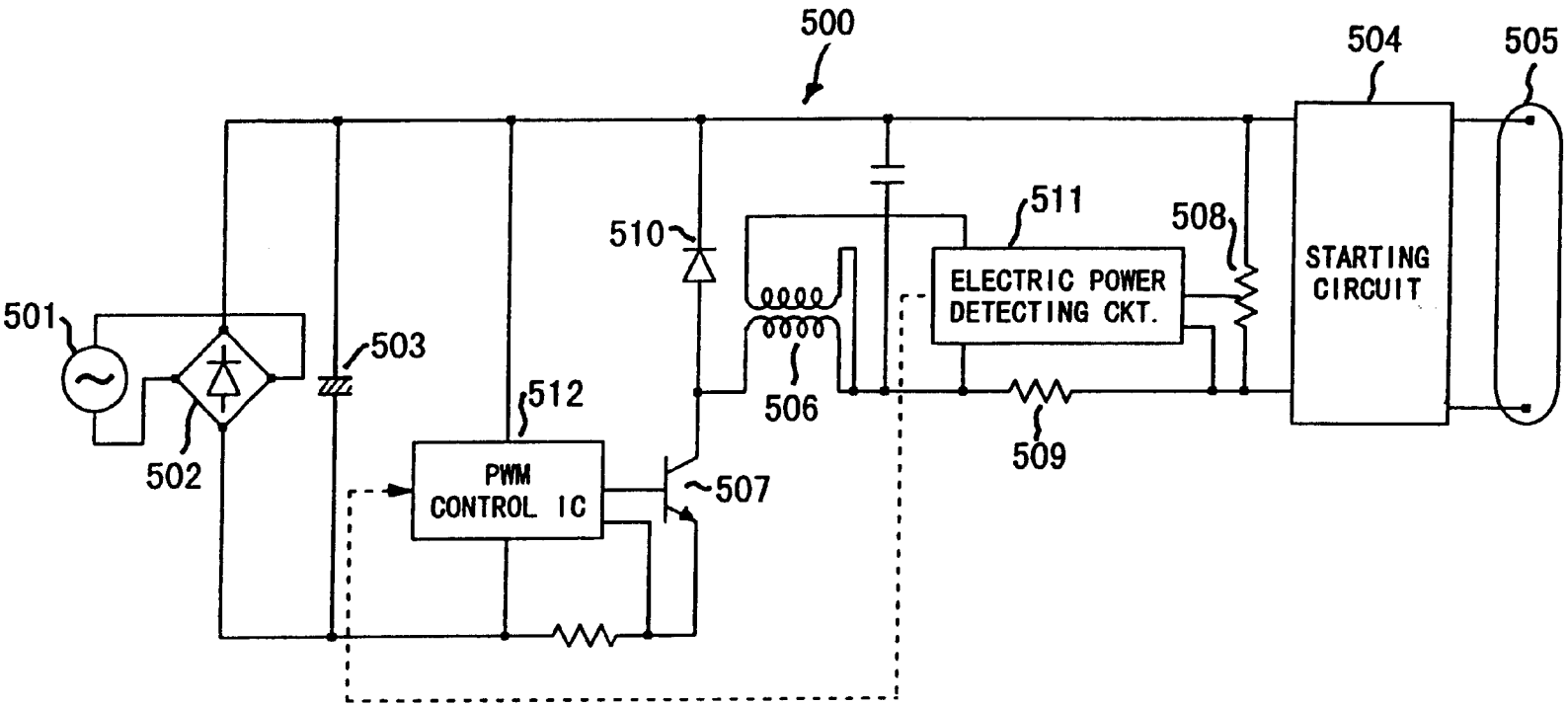
FIG. 1 (PRIOR ART)
FIG. 1 is a discharge lamp lighting circuit showing a conventional discharge lamp lighting apparatus as a prior art.
Figures 2A, 2B:
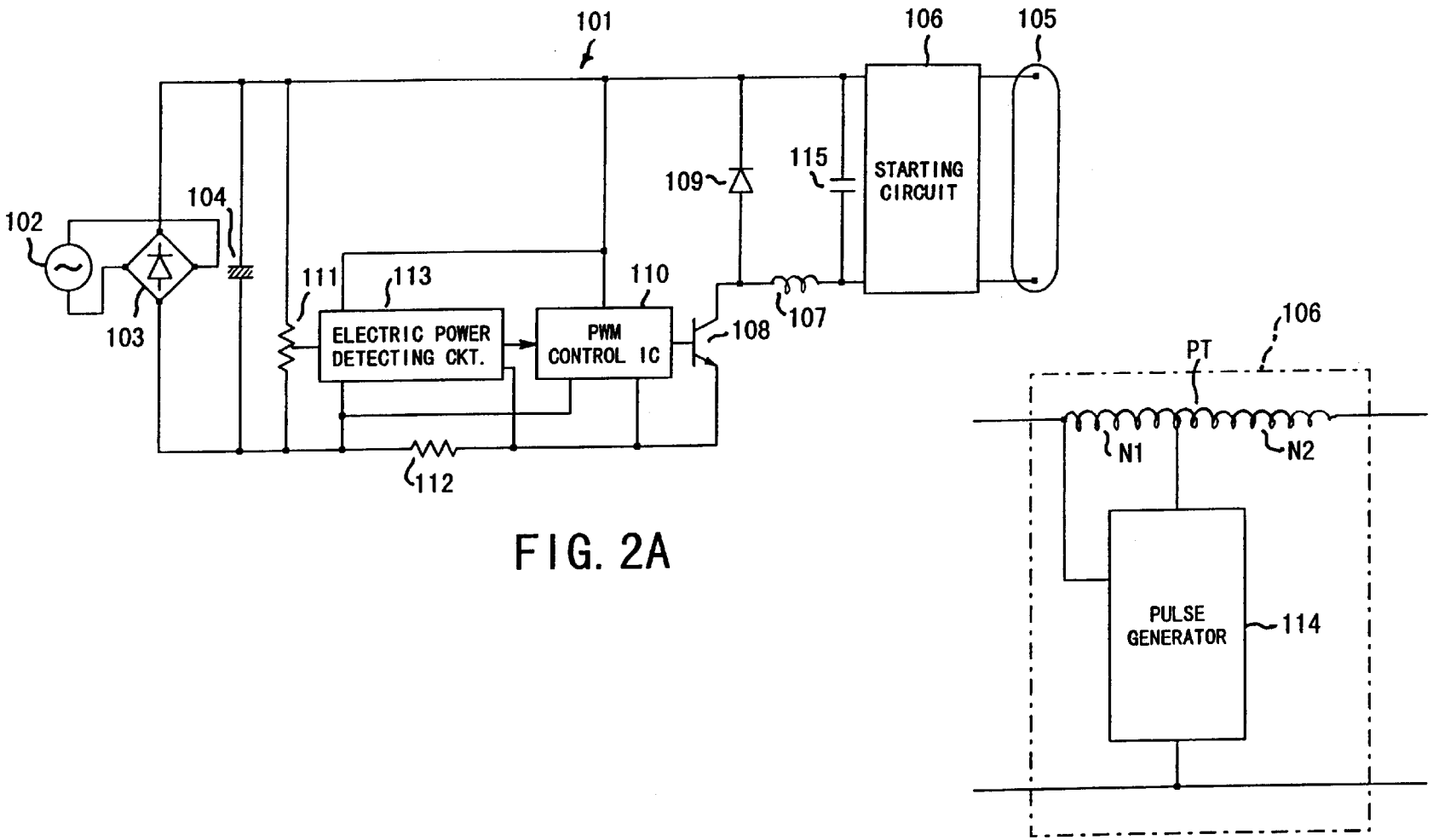
FIG. 2A is a discharge lamp lighting circuit showing a first embodiment of the discharge lamp lighting apparatus of the present invention.
FIG. 2B is a circuit showing an igniter in the discharge lamp lighting circuit shown in FIG. 2A in detail.

FIG. 2A is a circuit diagram showing, for instance, a lighting circuit using a metal halide lamp as a first embodiment of the discharge lamp lighting apparatus of the present invention.

A lighting circuit 101 is connected with a rectifier circuit 103 and a smoothing circuit 104 in order between it and an AC power source 102 side line. An starting circuit 106 to turn on a metal halide lamp 105 is connected to the output side lines of the rectifier circuit 103 and the smoothing circuit 104.

At the minus side of the starting circuit 106, a choke coil 107 and a switching transistor 108 which control supply power to the starting circuit 106 are connected in order. Further, between both terminals of the starting circuit 106, a diode 109 to circulate current from the choke coil 107 is connected with the cathode side set at the plus side. Furthermore, between both terminal of the starting circuit 106, a smoothing capacitor 115 is connected. PWM control IC 110 controls supply power to the starting circuit 106 by regulating base voltage of the switching transistor 108.

Between the output lines of the rectifier circuit 103 and the smoothing circuit 104, a voltage detecting resistor 111 is connected for measuring voltage by dividing it with a resistor. Further, a current detecting resistor 112 is connected to the cathode side line of the switching transistor 108 for detecting current from the switching transistor 108 by measuring voltage between both terminals.

Analog signal voltage from the voltage detecting resistor 111 and voltages at both terminals of the current detecting resistor 112 are input to an electric power detecting circuit 113 that is composed of a microcomputer and current lamp power consumption is estimated based on these voltage values. According to this estimated power consumption, a control signal is output to the PWM control IC 110 to control the lamp power consumption so as to maintain it at a constant level.

Further, both the PWM control IC 110 and the electric power detecting circuit 113 secure electric power from the outputs of the rectifier circuit 103 and the smoothing circuit 104. Further, the electric power detecting circuit 113 is connected to the AC power source 102 side rather than the switching transistor 108 and the diode 109 in the electric power supply line.

FIG. 2B shows a definite example of the starting circuit 106 shown in FIG. 2A. That is, the starting circuit 106 is composed of a pulse transformer PT and a pulse generator 114 to generate high-tension pulse by switching on the pulse transformer PT. The pulse transformer PT in single-winding structure with a primary side winding N1 and a secondary side winding N2 partially used commonly is used. The pulse transformer PT used here is made of a 33 mm long square sectional shaped bar core with the secondary side winding N2 (including the primary side winding N1) wound round and an inductance value of the secondary side winding N2 is as extremely small as 20 $\mu$H. A very thick polyurethane wire which is durable against large current is used for the winding.

Figure 3:
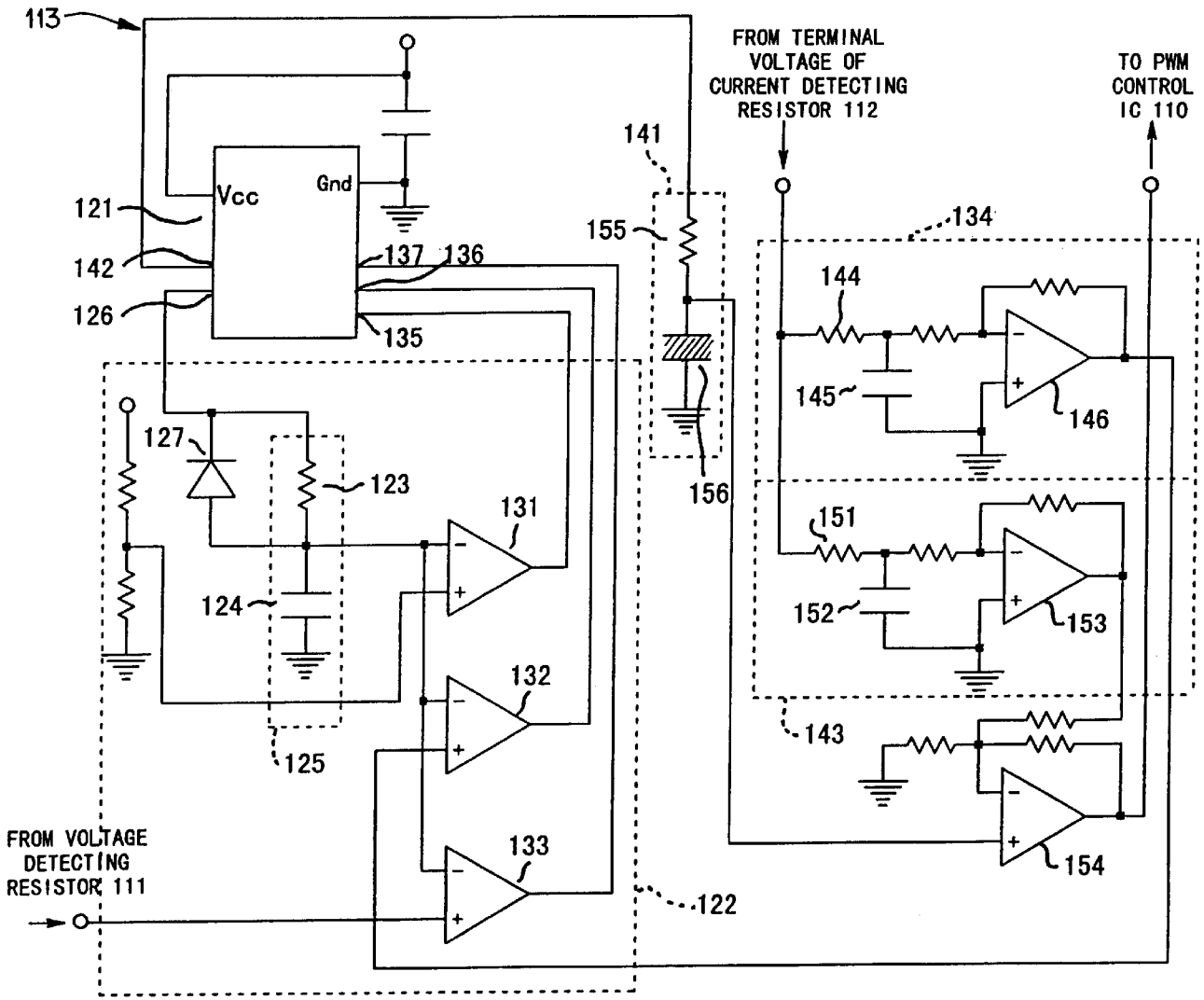
FIG. 3 is an electric power detecting circuit in the discharge lighting circuit shown in FIG. 2A.

FIG. 3 shows the circuit configuration of the electric power detecting circuit 113 composed of a microcomputer.

The electric power detecting circuit 113 is equipped with an IC 121. The IC 121 is a one-chip microcomputer which operates according to a program stored in an internal ROM and controls the PWM control IC 110.

An auxiliary circuit for A/D conversion 122 is equipped with a CR charging circuit 125 with a resistor 123 and a capacitor 124 connected in series. Further, a terminal 126 of the IC 121 is connected to the resistor 123 side terminal of the CR charging circuit 125 and the cathode side of a diode 127. The capacitor 124 side of the CR charging circuit 125 is connected to GND. Further, the charging side of the capacitor 124 is connected to the reverse input terminals of comparators 131, 132 and 133 and the anode side of the diode 127.

To the non-reverse input terminal of the comparator 131, the prescribed reference voltage is input. To the non-reverse input terminal of the comparator 133, the analog signal voltage from the voltage detecting resistor 111 is input. To the non-reverse input terminal of the comparator 132, the output voltage of a low-frequency amplifier circuit 134, which will be described later, is input. The output terminals of the comparators 131, 132 and 133 are connected to terminals 135, 136 and 137 of the IC 121.

A D/A converter 141 is a primary type low-pass filter comprising a resistor 155 and a capacitor 156 both of which are connected each other in series. The resistor 155 side is connected to a terminal 142 of the IC 121 and the capacitor 156 side is connected to GND. Further, the charging side of the capacitor 156 is connected to the non-reverse input terminal of an amplifier 154.

The terminal voltage of the current detecting resistor 112 is input to the low-frequency amplifier circuit 134 and a high-responsive amplifier circuit 143.

The low-frequency amplifier circuit 134 is composed of a resistor 144, a capacitor 145 and an operational amplifier 146. Out of the terminal voltages of the current detecting resistor 112, relatively low-frequency component that depends on a CR time constant according to the resistor 144 and the capacitor 145 is amplified by the operational amplifier 146 and output to the comparator 132. The high-responsive amplifier circuit 143 is composed of a resistor 151, a capacitor 152 and an operational amplifier 153. Out of the terminal voltages of the current detecting resistor 112, a relatively high-frequency component that depends on a CR time constant according to the resistor 151 and the capacitor 152 is also amplified by the operational amplifier 153 and output to the reverse input terminal of an amplifier 154. To the non-reverse input terminal of the amplifier 154, the output voltage of the D/A converter 141 is input.

Next, the operation of the lighting circuit 101 will be described.

First, a voltage value Vv detected by the voltage detecting resistor 111 and a voltage value Vi that is a value converted from the current detected by the current detecting resistor 112 are A/D converted as shown below. Here, the voltage Vi is a voltage proportional to a mean value of voltages at both terminals of the current detecting resistor 112 with only low-frequency component below about 10 Hz amplified by the low-frequency amplifier circuit 134 excluding the high-frequency portion.

First, a circuit and an algorithm are initialized. That is, the CR charging circuit 125 is discharged and the internal counter of the IC 121 is initialized.

Then, the charging of the CR charging circuit 125 is started and the following times l1, V1 and R1 that are required until voltage of the capacitor 124 becomes equal to voltage Vi, voltage Vv and reference voltage Vref (e.g., 2 [V]) are measured, respectively.

l1=A time when the voltage of the capacitor 124 is lower than the voltage Vi. That is, a time required for the voltage of the capacitor 124 from starting the charging until crossing the voltage value Vi.

V1=A time when the voltage of the capacitor 124 is lower than the voltage Vv. That is, a time required for the voltage of the capacitor 124 from starting the charging until crossing the voltage value Vv.

R1=A time when the voltage of the capacitor 124 is lower than the reference voltage Vref. That is, a time required for the voltage of the capacitor 124 from starting the charging until crossing the voltage value of Vref.

That is, the IC 121 inputs pulse signal in a fixed width to the CR charging circuit 125 from the terminal 126 and starts the charging of the CR charging circuit 125. As a result, pulse voltage in a fixed integral waveform that becomes gradually large according to the CR time constant of the CR charging circuit 125 is input to the reverse input terminals of the comparators 131, 132 and 133.

As a fixed reference voltage Vref (2 V) is input to the non-reverse input terminal of the comparator 131, pulse voltage in always constant pulse width is input to the IC 121. As the voltage Vv from the voltage detecting resistor 111 is input to the non-reverse input terminal of the comparator 133, pulse voltage in pulse width corresponding to size of this fluctuating voltage is input to the terminal 136 of the IC 121. As the voltage Vi which is amplified low-frequency component of the terminal voltage of the current detecting resistor 112 is input to the non-reverse input terminal of the comparator 132, pulse voltage in pulse width corresponding to size of this fluctuating voltage is input to the terminal 137 of the IC 121.

The IC 121 measures pulse widths (R1, l1 and V1, respectively) of the pulse voltages input through the terminals 135, 136 and 137 by the internal counter and by performing the comparative operation of time R1 with time l1 and time R1 with time V1, is able to obtain the digital values of voltage and current values measured in the power supply line to the metal halide lamp 105. Further, the comparative operation with time R1 is performed for eliminating, for instance, a measuring error due to the fluctuation of electrostatic capacity of the capacitor 124 or a measuring error due to fluctuation of voltage output from the terminal 126.

The IC 121 obtains an input power value to the metal halide lamp 105 by multiplying these voltage and current values measured in the power supply line. Then, this input power value is compared with a desired power value that was preset in an internal ROM, etc. If the input power value is lower than the desired power value as a result of the comparison, a control signal is output from the terminal 142 to increase a duty ratio of the pulse current supplied to the metal halide lamp 105 by the PWM control so as to control the supply power to the metal halide lamp 105 at a constant level. If the input power value is higher than the desired power value as a result of the comparison, a control signal is output from the terminal 142 to reduce the duty ratio of the pulse current supplied to the metal halide lamp 105 by the PWM control so as to control the supply power to the metal halide lamp 105 at a constant level.

That is, when a period when the switching transistor 108 is kept ON becomes long, the electric power supplied to the metal halide lamp via the choke coil 107 increase and electric power that is stored also increases during this period.

When the switching transistor 108 is kept OFF, the electric power stored in the smoothing capacitor 115 is supplied to the metal halide lamp 105 via the choke coil 107 and the lamp is continuously kept ON.

Definitely, a counter that is equivalent to the number of bits of the control signal output from the terminal 142 is provided in the IC 121. If the input electric power is low, this counter is incremented by one count and the control signal is output to the D/A converter 141. If the input electric power is high, this counter is decreased by one count and the control signal is output to the D/A converter 141. Further, if it is desired to perform a process of good response, the P control may be used to output a difference from a desired power value to the D/A converter 141. Further, the P control referred to here denotes the proportional control and is a technique to regard a value of constant times of an error=(desired value−current value) as an operating value.

The control signal output from the terminal 142 is D/A converted in the D/A converter 141 and input to the non-reverse input terminal of the amplifier 154. Further, the high-responsive amplifier 143 amplifies relatively high frequency component of 1 KHz−10 KHz out of the terminal voltage of the current detecting resistor 112 and inputs to the reverse input terminal of the amplifier 154. Then, the amplifier 154 reduces the voltage that is output by the high-responsive amplifier 143 from the output voltage of the D/A converter 141, amplifies it and outputs to the PWM control IC 110.

Thus, it is possible to cover the slow operating speed of the IC 121 and rapidly correct sudden current increase to the metal halide lamp 105.

Further, the IC 121 computes an approximate voltage of the metal halide lamp 105 according to the equation (4) shown below:

Metal halide lamp voltage=Measured voltage value of the power supply line×ON time ratio (duty ratio) of pulse current supplied to the metal halide lamp by PWM control (4)

Then, if the voltage of the metal halide lamp 105 obtained by this computation is out of the values in the preset range, the counter in the IC 121 is incremented by one count and on the contrary, if it is within values in the preset range, the count is decreased by one count.

Then, if this count exceeds a specified value in a preset fixed time, the voltage of the metal halide lamp is judged to be abnormal and by reducing the ON time ratio of the pulse current supplied to the metal halide lamp to zero (0) by the PWM control and the metal halide lamp 105 is turned OFF. Thus, by indirectly measuring the electric power supplied to the metal halide lamp 105 by measuring the voltage and current of the power supply line, it is possible to prevent a problem when the voltage of the metal halide lamp 105 becomes unstable.

Further, as the IC 121 comprising the microcomputer is used for the constant power control of the metal halide lamp 105 in this lighting circuit 101, a problem of the voltage of the metal halide lamp becoming unstable can be prevented in the same circuit configuration. Therefore, no new circuit element is required and the circuit configuration can be made simple.

The voltage of the metal halide lamp 105 may be obtained according to an equation (5) shown below instead of the equation (4) described above. That is, Voltage of the metal halide lamp=Measured value of the power supply line voltage×ON time ratio of pulse current supplied to the metal halide lamp by the PWM control×a correction factor relative to the voltage value of the power supply line (5)

Figure 4:
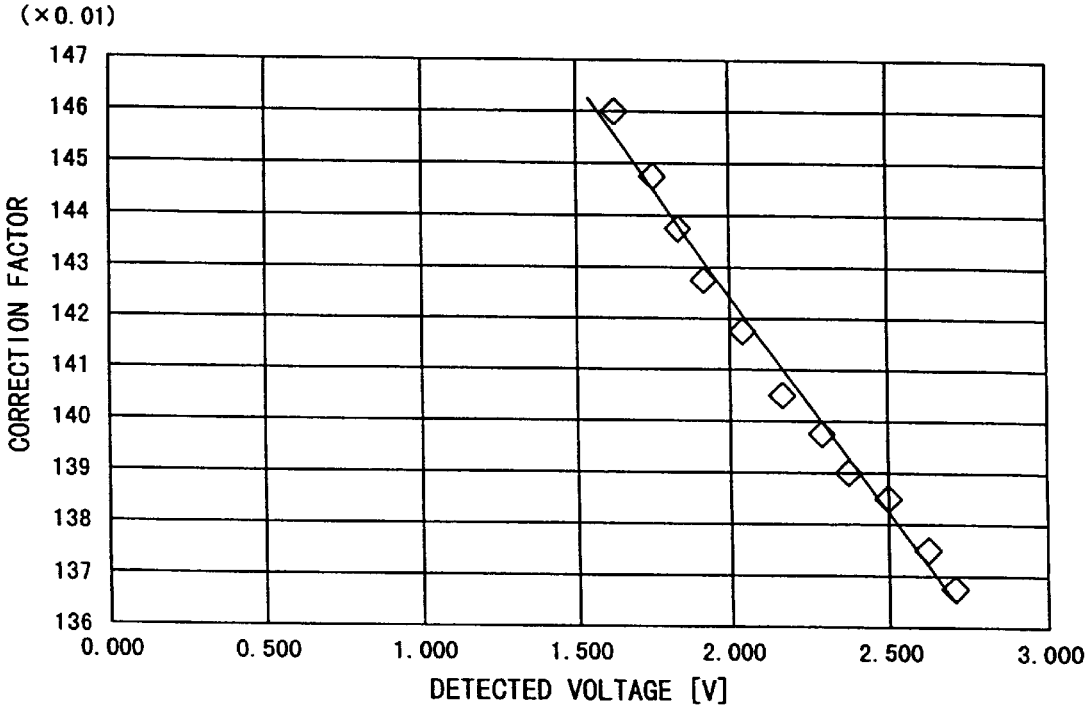
FIG. 4 is a graph showing examples of correction factors that are used by the electric power detecting circuit shown in FIG. 3.

Correction factors for the equation (5) are shown in FIG. 4. These correction factors can be obtained experimentally from the voltage values of the power supply line detected by the voltage detecting resistor 111 and an actually measured values of the metal halide lamp 105. By approximating these values by an equation (6) shown below, they are made final correction factors.

Correction factor relative to voltage value of the power supply line=Measured voltage value of the power supply line×A−B (6)

In the equation (6), A and B are constants.

As described above, it is possible to detect an accurate voltage according to the method shown by the equation (4) using a correction factor to obtain the voltage of the metal halide lamp 105. Therefore, it is possible to detect theabnormal voltage of the metal halide lamp 105 accurately and thereby, rapidly prevent a problem.

Further, the voltage of the metal halide lamp 105 may be obtained according to an equation (7) shown below instead of the equation (5). That is, a table showing the equation (7) is preset in the ROM in the IC 121 and by looking up this table, the voltage of the metal halide lamp 105 is obtained using a correction factor.

$$\text{Voltage of the metal halide lamp}=F(x, y) \quad (7)$$

In the equation (7), F (x, y) is a function with variables x and y, x is a measured voltage value of the power supply line, and y is an ON time ratio (duty ratio) of the pulse current supplied to the metal halide lamp by the PWM control.

Figure 5:
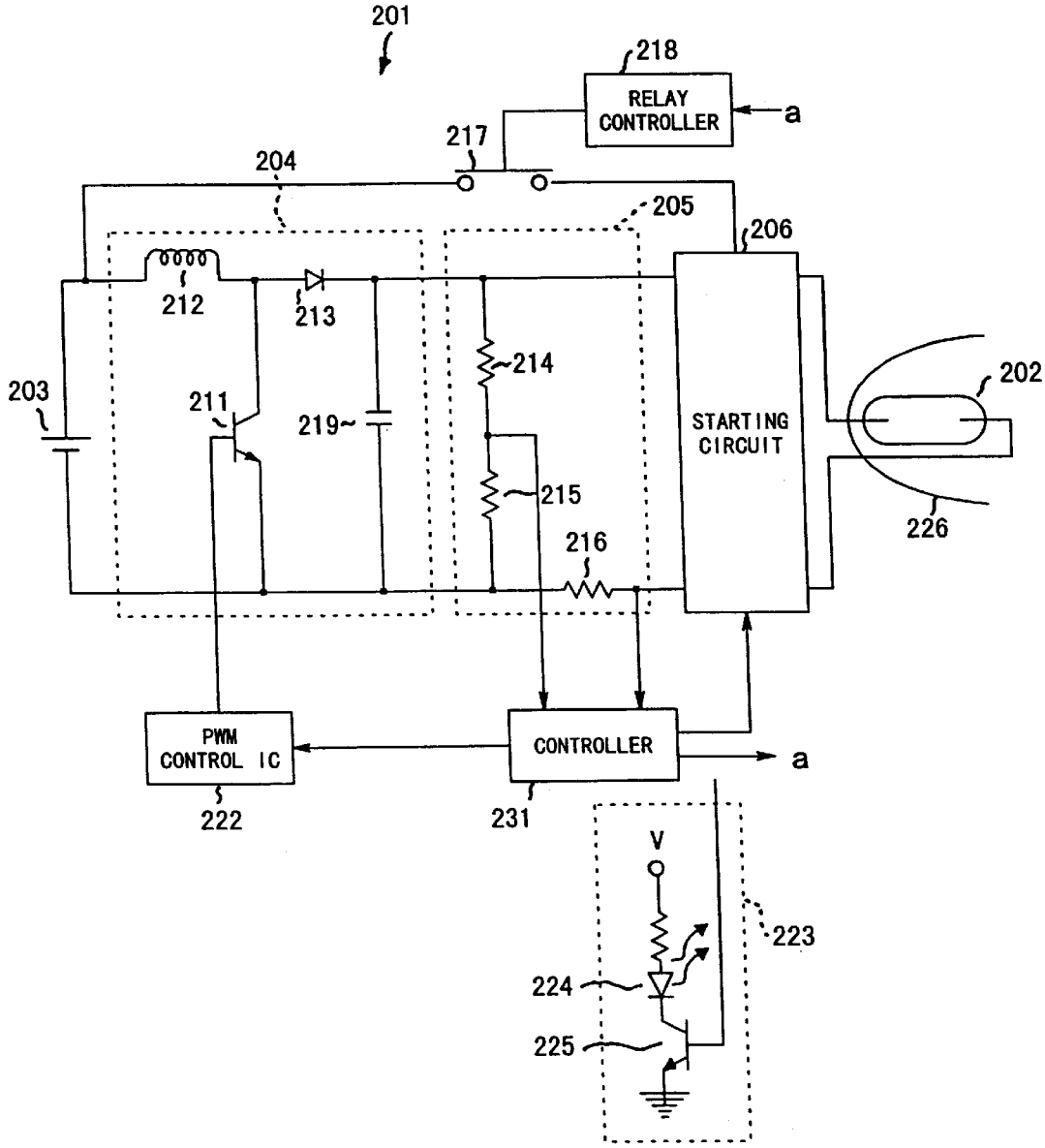
FIG. 5 is a discharge lamp lighting circuit showing a second embodiment of the discharge lamp lighting apparatus of the present invention.

FIG. 5 is a circuit diagram of a high-pressure discharge lamp lighting apparatus showing a second embodiment of the present invention.

The lighting apparatus 201 is provided at the front head of a car and a case to turn on a high-pressure discharge lamp 202 that is used as a head lamp of the car is shown here.

As shown in FIG. 5, in the lighting apparatus 201, an operating circuit (DC-DC converter) 204, a voltage/current sensor 205, a starting circuit 206 and a high-pressure discharge lamp 202 are connected to the power source line of a DC power source 203. The operating circuit 204 boosts the voltage of the DC power source 203 and turns on the high-pressure discharge lamp 202. The voltage/current sensor 205 detects voltage and current of the high-pressure discharge lamp 202. The starting circuit 206 starts the high-pressure discharge lamp 202.

The operating circuit 204 is in a well-known circuit configuration equipped with a switching element 211, a choke coil 212 and a diode 213.

The voltage/current sensor 205 is equipped with a resistor 214 one end of which is connected to the plus side of the output line of the operating circuit 204, a resistor 215 which is connected to this resistor 214 in series and a resistor 216 connected to the minus side of the output line of the operating circuit 204. The voltage/current sensor 205 is in such a well-known configuration that the lamp voltage of the high-pressure discharge lamp 202 is detected by dividing the output voltage of the operating circuit 204 by the resistors 214 and 215 and the lamp current is detected according to voltage drop in the resistor 216.

The starting circuit 206 is in a well-known circuit configuration to start the high-pressure discharge lamp 202 by giving the starting pulse to it. The starting circuit 206 is connected with a line to input the voltage that is led from the former stage position than the switching element 211 of the power source line in order to start/stop the starting circuit 206. To this line, a relay 217 is connected. This relay 217 is opened/closed by a relay controller 218.

In an isolation transformer 221, the primary side winding is connected to a PWM control IC 222, one end side of the secondary winding is connected to the base of the switching element 211 and the other end side is connected to the emitter side of the switching element 211. The PWM control IC 222 turns the switching element 211 ON/OFF at a variable ON time ratio by way of the isolation transformer 221 and PWM controls the supply power to the high-pressure discharge lamp 202 from the operating circuit 204.

An annunciator 223 is equipped with an LED (Light Emitting Diode) 224 provided in a compartment and a switching element 225 which turns on or off this LED 224. There is provided a reflector 226 on the back of the high-pressure discharge lamp 202.

A controller 231 is connected with the voltage/current sensor 205, the relay controller 218, the PWM control IC 222 and the annunciator 223, and the controller 231 controls the relay controller 218, the PWM control IC 222 and the annunciator 223. That is, the controller 231 obtains the lamp electric power based on the lamp voltage and the lamp current detected by the voltage/current sensor 205 and sends a control signal to the PWM control IC 222. There is provided a lamp power controller (not shown) in a well-known circuit configuration to control the lamp electric power to a constant level by switching the switching element 211 at a variable ON time ratio according to this control signal.

Figure 6:
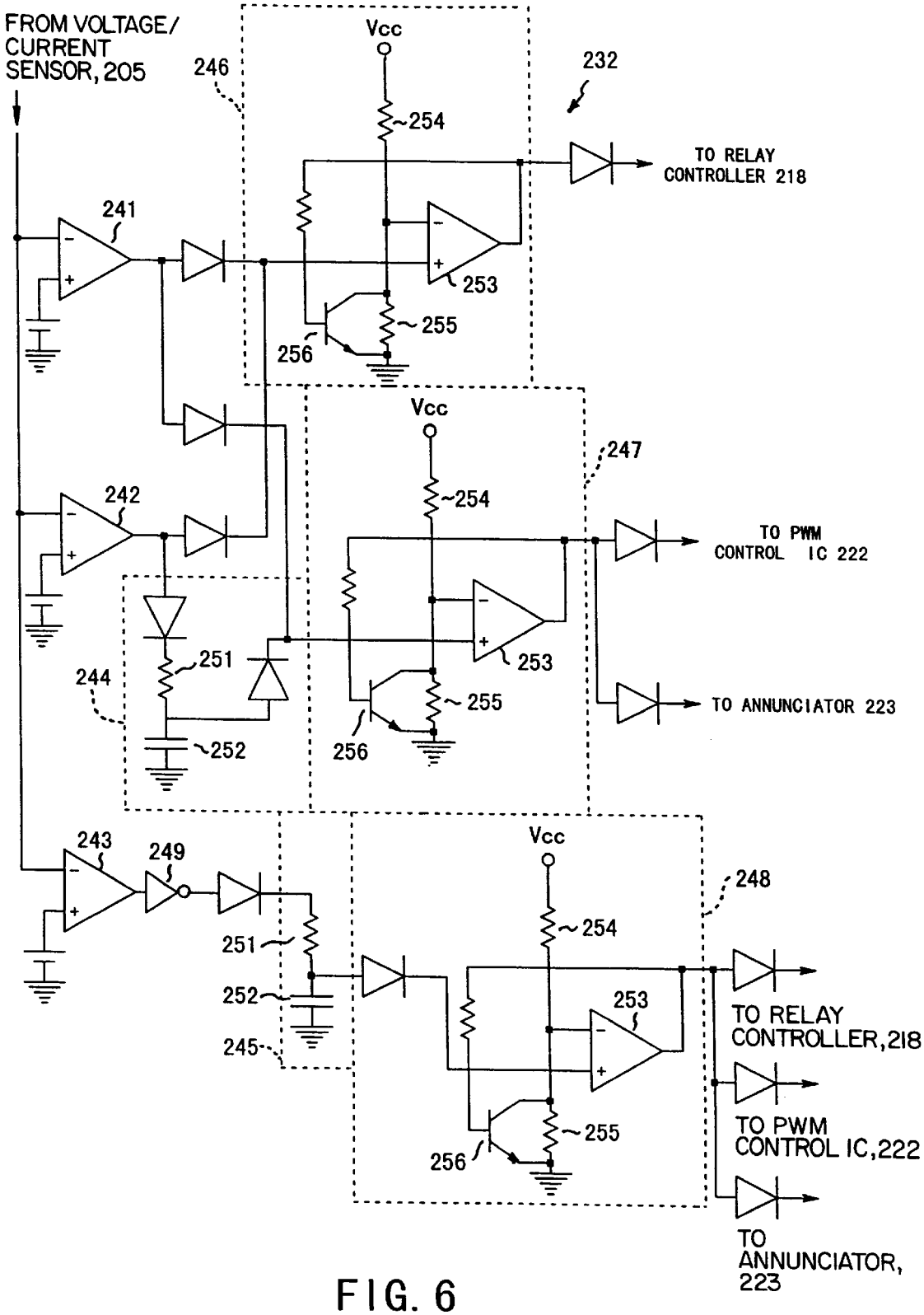
FIG. 6 is a lamp turn-off circuit in the discharge lamp lighting circuit shown in FIG. 5.

Further, the controller 231 is equipped with a lamp turning off circuit 232 shown in FIG. 6.

As shown in FIG. 6, this lamp turning off circuit 232 is equipped with comparators 241, 242 and 243, and the lamp voltage detected by the voltage/current sensor 205 is input to the reverse input terminal of each of these comparators. To the non-reverse input terminal of the comparator 241, a fixed voltage (a second threshold value) small than a rated lamp voltage in a fixed range that is preset for the high-pressure discharge lamp 202 is input as the reference value. To the non-reverse input terminal of the comparator 242, a fixed voltage (a first threshold value) smaller than the rated lamp voltage described above and larger than the second threshold value is input as the reference value. To the non-reverse input terminal of the comparator 243, a fixed voltage (a third threshold value) larger than the rated lamp voltage is input.

The output terminal of the comparator 241 is connected to each of the input sides of latch circuits 246 and 247. The output terminal of the comparator 242 is connected to the input terminal of a latch circuit 246 and that of a timer circuit 244. The output side of this timer circuit 244 is connected to the input side of the latch circuit 247. The output side of the comparator 243 is connected to the input terminal side of an inverter 249. The output terminal side of this inverter 249 is connected to the input side of a timer circuit 245. The output side of this timer circuit 245 is connected to the input side of a latch circuit 248.

The timer circuits 244 and 245 are in the similar circuit configuration and are composed of a resistor 251 and a charging capacitor 252 which are connected in series, and voltages corresponding to the input voltages from the comparator 242 and the inverter 249 and RC time constants by the resistor 251 and the charging capacitor 252 are output to the latch circuits 247 and 248.

The latch circuits 246, 247 and 248 are in the similar configuration. That is, the output voltage of the comparators 241, 242 and the inverter 249 are input to the non-reverse input terminal of a comparator 253. Further, there is provided a reference voltage input circuit equipped with in-series connected resistors 254 and 255 and supply voltage Vcc is input to the reverse input terminal of the comparator 253 after its voltage level is lowered by theresistor 254. To both terminals of the resistor 255, the collector side and the emitter side of a switching element 256 are connected. The output terminal of the comparator 253 is connected to the output side of the latch circuits 246, 247 and the base side of the switching element 256.

From the output side of the latch circuit 246, the control signal voltage is output to the relay controller 218. From the output side of the latch circuit 247, the control signal voltage is output to the PWM control IC 222 and the annunciator 223. From the output side of the latch circuit 248, the control signal voltage is output to the relay controller 218, the PWM control IC 222 and the annunciator 223.

Next, the operation of the lighting circuit 201 in the structure as described above will be explained.

The lighting operation of the high-pressure discharge lamp 202 is carried out as shown below. That is, the control signal is output to the PWM control IC 222 by a lamp power controller (not shown) of the controller 231 to start the ON/OFF operation of the switching element 211. By this ON/OFF operation, the operating circuit 204 supplies the electric power to a load side. The relay 217 is always kept closed and when the electric power is supplied by the operating circuit 204, the starting circuit 206 applies the starting pulse to the high-pressure discharge lamp 202, which is then turned ON by the electric power supplied by the operating circuit 204.

The lamp voltage has such a characteristic that when lighting the high-pressure discharge lamp 202, the lamp voltage is kept in a low voltage state for a while immediately after the lamp is turned ON as described above and thereafter, increases to the rated lamp voltage.

So, in the low voltage state immediately after starting to light, if an abnormally low lamp voltage is shown because of leakage of the high-pressure discharge lamp 202 and drops to below the second threshold value, the comparator 241 outputs the H level voltage. This H level voltage is input to the latch circuit 246 and the timer circuit 244.

In the latch circuit 246, the H level signal is input to the non-reverse input terminal of the comparator 253 and the comparator 253 outputs the H level signal to the relay controller 218 and the base side of the switching element 256. As a result, the relay controller 218 opens the relay 217 and immediately stops the starting circuit 206.

Further, as the switching element 256 is turned ON and both ends of the resistor 255 are short-circuited, reference voltage that is input to the comparator 253 drops to the GND level. As the H level signal output to the relay controller 218 is thus latched, even if the lamp voltage rises for some reason thereafter, the starting circuit 206 is prevented from being restarted until the power source is turned ON again or the lamp lighting signal is input again.

The H level signal output from the comparator 241 is also input to the latch circuit 247 and the comparator 253 also outputs the H level signal to the PWM control IC 222 and the annunciator 223. As a result, the PWM control IC 222 stops the switching element 211 to turn ON/OFF and therefore, the operating circuit 204 is stopped immediately. Further, the switching element 225 of the annunciator 223 is turned ON, the LED 224 is turned ON and it is announced that the lighting of the high-pressure discharge lamp 202 was stopped.

When the lamp voltage is higher than the second threshold value but lower than the first threshold value, the comparator 242 outputs the H level voltage to the latch circuit 246 and the timer circuit 244. When the H level voltage is output to the latch circuit 246, the starting circuit 206 stops immediately likewise the above and this stopped state is latched.

Further, as the H level voltage is also input to the timer circuit 244, only when the state of the lamp voltage lower than the first threshold value was continued for a prescribed time, the comparator 253 outputs the H level signal to the PWM control IC 222 and the annunciator 223. As a result, the operating circuit 204 stops and at the same time, the LED 224 is turned ON. Further, these state are latched by the latch circuit 247 likewise the above.

When the lamp voltage exceeds the third threshold value as the high-pressure discharge lamp 202 reaches the end of its service life, the comparator 243 outputs the L level voltage and the inverter 249 reverses this L level voltage to the H level voltage and outputs to the timer circuit 245. Then, as this H level voltage is input to the timer circuit 245, only when the state of the lamp voltage exceeding the third threshold value was continued for a prescribed time, the comparator 253 of the latch circuit 248 outputs the H level voltage to the relay controller 218, the PWM control IC 222 and the annunciator 223, the lighting circuit 248 and the starting circuit 206 stop to operate and the LED 224 is turned ON. Further, the latch of the H level voltage output of the comparator 253 of the latch circuit 248 is the same as in the latch circuits 246 and 247.

Figure 7:
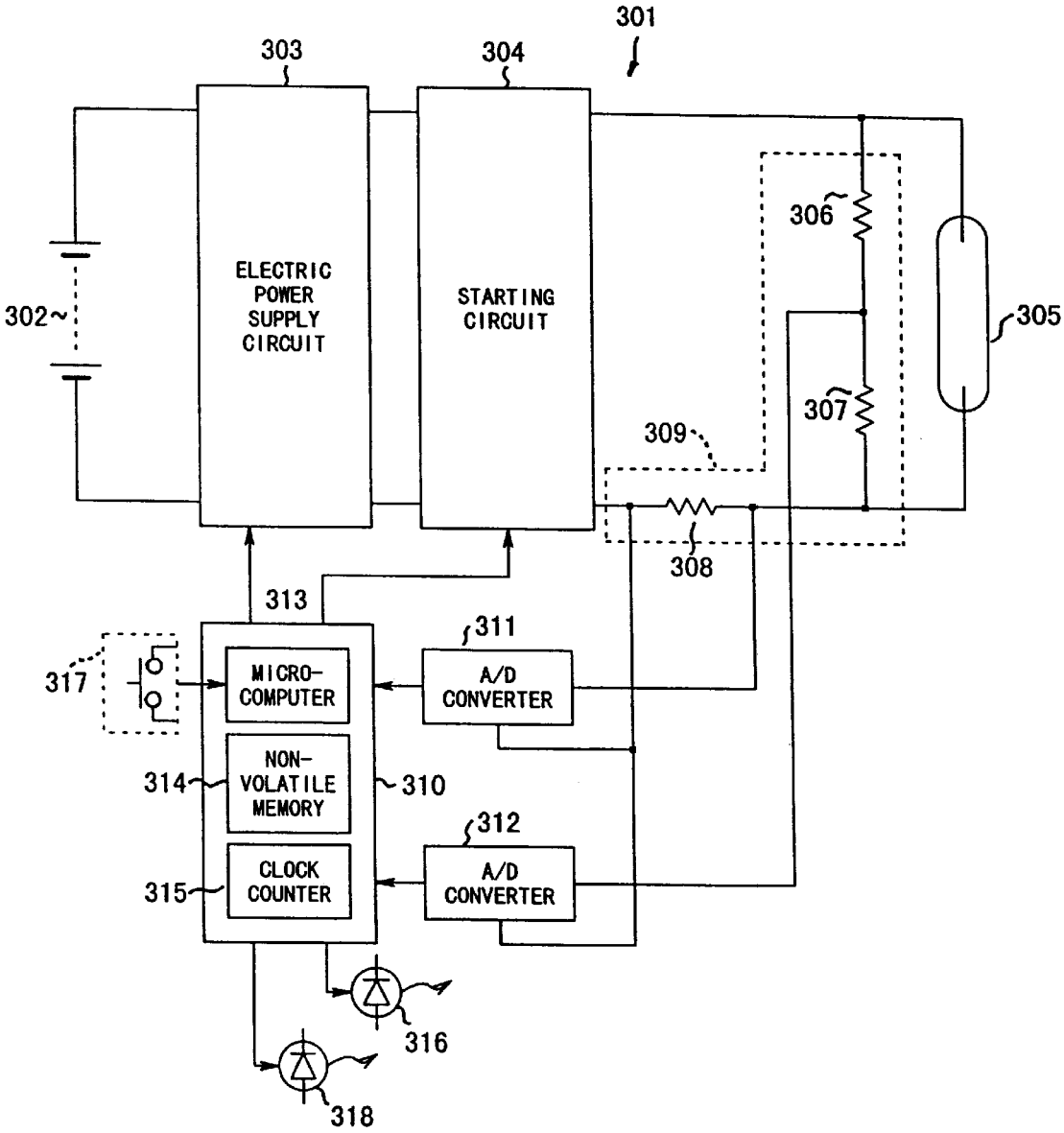
FIG. 7 is a discharge lamp lighting circuit showing a third embodiment of the discharge lamp lighting apparatus.

FIG. 7 is a circuit diagram showing a third embodiment of the discharge lamp lighting apparatus of the present invention.

As shown in FIG. 7, in a lighting apparatus 301, an electric power supply circuit 303 and a starting circuit (a high-tension pulse generator) 304 in a well-known structure are connected to the output line of a DC power source 302. A high-pressure discharge lamp 305 is connected to the output line of the starting circuit 304. In the lighting apparatus 301, the supply power to the high-pressure discharge lamp 305 is controlled so that it is kept at a fixed level (this level is variable) according to the well-known structure.

Further, between both terminals of the high-pressure discharge lamp 305, a voltage/current detecting circuit 309 is connected. This voltage/current detecting circuit 309 detects the lamp voltage of the high-pressure discharge lamp 305 by dividing the voltage by resistors 306 and 307 and detects the lamp current of the high-pressure discharge lamp 305 by the terminal voltage of a resistor 308.

The reference numeral 310 indicates a control device of the lighting apparatus 301. To this control device 310, the digital signal converted from analog signal output from the voltage/current detecting circuit 309 by A/D converters 311 and 312 is input.

The control device 310 is equipped with a microcomputer 313, a non-volatile memory 314 comprising an EEPROM and etc., and a clock counter 315. The microcomputer 313 executes various operations based on the digital signals input from the A/D converters 311 and 312 according to the prescribed programs and fixed data stored in a built-in ROM. The control device 310 stores various data showing the lighting history of the high-pressure discharge lamp 305 in the non-volatile memory 314. Further, the control device 310 turns the clock counter 315 ON/OFF and outputs the control signal for driving the electric power supply circuit 303, the starting circuit 304, a first LED display 316 and a second LED display 318. The first LED display 316 indicates that the high-pressure discharge lamp 305 is almost at the end of its life but still able to turn on. The second LED display 318 indicates that the high-pressure discharge lamp 305 is at the end of its life and in danger of blowing up. Further, the control device 310 is connected with a reset switch 317 and the non-volatile memory 314 is initialized by the reset operation of the reset switch 317.

Figure 8:
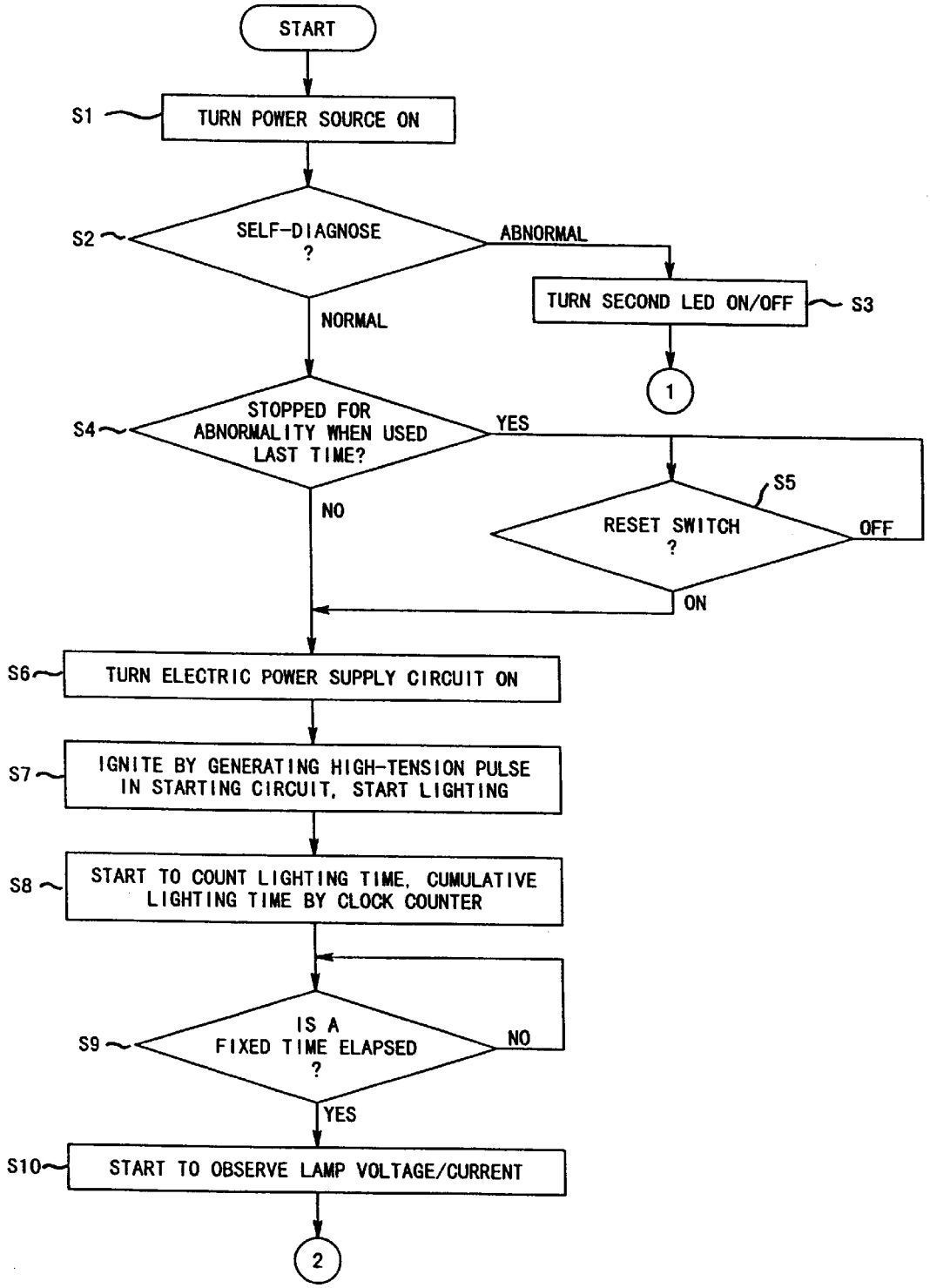
FIG. 8 and FIG. 9 are flowcharts for explaining the operation in the third embodiment.
Figure 9:
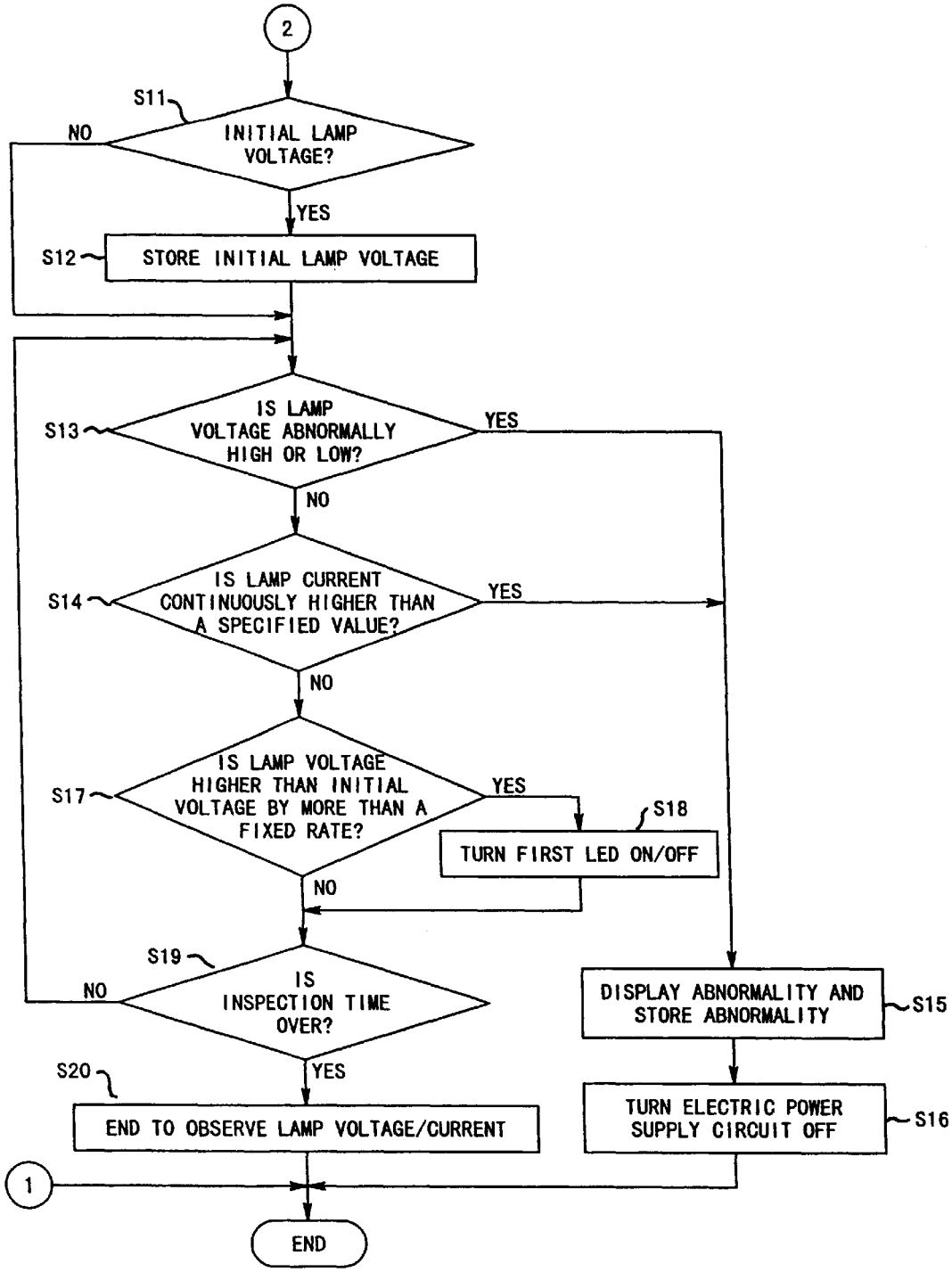

Next, the operation of the lighting apparatus 301 in the structure described above will be explained centering around the operation of its control system referring to the flowcharts shown in FIG. 8 and FIG. 9.

When the power source of the lighting apparatus 301 is turned ON, first a CPU built in the microcomputer 313 diagnoses whether the operations of all parts of the microcomputer 313 and the contents of the non-volatile memory 314 are proper (Steps S1 and S2). If there is any abnormal condition, the CPU informs it by turning the second LED display 318 ON and OFF and terminates (Step S3). If normal, the operation is shifted to the judgment in Step S4.

In Step 4, it is judged whether the lamp lighting was stopped as judged that there was the prescribed abnormal condition when the high-pressure discharge lamp 305 was used last time. That is, as described later, in this lighting apparatus, any abnormality of the high-pressure discharge lamp 305 is automatically detected and data showing that abnormality and abnormality indication are stored in the non-volatile memory 314 and when an abnormality is detected, the operation is executed to automatically turn off the electric power supply circuit 303. When data showing an abnormality and its indication were left in the non-volatile memory 314, the electric power supply circuit 303 is not turned ON unless the lighting apparatus is reset by the reset switch 317 (Steps S4, S5 and S6) and therefore, user exchanges a lamp and performs the reset operation.

Only when no lamp abnormality was found in the last high-pressure discharge lamp lighting or the lamp abnormality was found and a lamp was exchanged and the reset operation was performed, the control signal is output to turn on the electric power supply circuit 303. When the electric power supply circuit 303 is turned on by the control signal from the control device 310, the high-tension pulse is generated from the starting circuit 304. The high-pressure discharge lamp 305 is ignited by this high-tension pulse and starts to light (Steps S6 and S7). Further, the clock counter 315 is driven to measure the ON time of this time and a cumulative ON time of the high-pressure discharge lamp 305 currently in use 315 (Step S8).

The electrical characteristic of the high-pressure discharge lamp 305 varies according to its temperature. So, waiting the lapse of a fixed time (generally, 10 to 30 min.) until the electrical characteristic is stabilized after starting the lighting by measuring the ON time by the clock counter 315, the observation of lamp voltage and current is started (Steps S9 and S10). Then, if the high-pressure discharge lamp is a virgin lamp, the lamp voltage at that time is stored in the non-volatile memory 314 as the initial lamp voltage (Steps S11 and S12). It is possible to detect whether the high-pressure discharge lamp 305 is a virgin lamp by checking whether the reset operation was made this time by the reset switch 317.

Then, it is judged whether the lamp voltage is abnormally high or low (Step S13). In addition, it is judged whether the lamp current is continuously higher than a fixed specified value (the CPU of the microcomputer 313 obtained from the initial lamp voltage and stored in the non-volatile memory 314) (Step S14).

That is, if the lamp voltage drops to below a fixed value (the CPU of the microcomputer obtained from the initial lamp voltage and stored in the non-volatile memory 314) during the lighting, it is judged that the glass tube of the high-pressure discharge lamp 305 is damaged/out of order or the lighting device 301 is out of order. On the contrary, if the lamp voltage increases extremely, it is judged that the lighting device 301 is out of order.

Further, if the lamp current is continuously high after the lighting, the stress may be accumulated at the sealing portions of the roots of the electrodes due to increasing heat generated at the electrodes of the high-pressure discharge lamp 305, and cracks may be generated and the rapture may result. So, when the lamp current is higher than a specified value, the counter in the microcomputer 313 is incremented and a continuous time of the abnormal state is counted. If the abnormality continued for a certain time, it is judged that the high-pressure discharge lamp 305 is out of order.

When it was judged in Steps S13 and S14 that there was an abnormality as described above, the abnormality indication and that abnormality are stored in the non-volatile memory 314 and the electric power supply circuit 303 is turned OFF (Steps S15 and S16) and the operation is terminated.

When no abnormality was detected in Steps S14 and S15, it is judged whether the lamp voltage is higher than the initial voltage by more than a certain ratio (Step S17). That is, the life performance characteristic of the high-pressure discharge lamp 305 at its end of life generally increases with the consumption of electrodes and therefore, when the lamp voltage increases by a certain ratio from the initial lamp voltage, the lamp life is judged to have been exhausted. In this case, therefore, the first LED display 316 is turned ON to urge user to exchange a lamp (Step S18).

Then, for a certain time (for instance, 20 minutes) from the start of observing the lamp voltage and current (Step S10), the judgments in Steps S13 through S17 are repeated and when this time is over, the observation of the lamp voltage and current is terminated (Step S19 and S20). Thereafter, the high-pressure discharge lamp 305 is kept ON continuously until the power source of the lighting device 301 is turned OFF.

In the case of the third embodiment, in order to detect the lamp life, after waiting until the electrical characteristics of the high-pressure discharge lamp 305 are stabilized, the initial lamp voltage is compared with the current lamp voltage. Therefore, during the period from starting the lighting until the electrical characteristics are stabilized, the high-pressure discharge lamp 305 may possibly be overheated and damaged. A modified embodiment described below has been devised to be able to detect the lamp life at the early stage when the lamp is turned ON in order to solve such the problem.

The lighting device in this deformed embodiment is in the same structure as in the third embodiment and therefore, the detailed explanation will be omitted.

Figure 10:
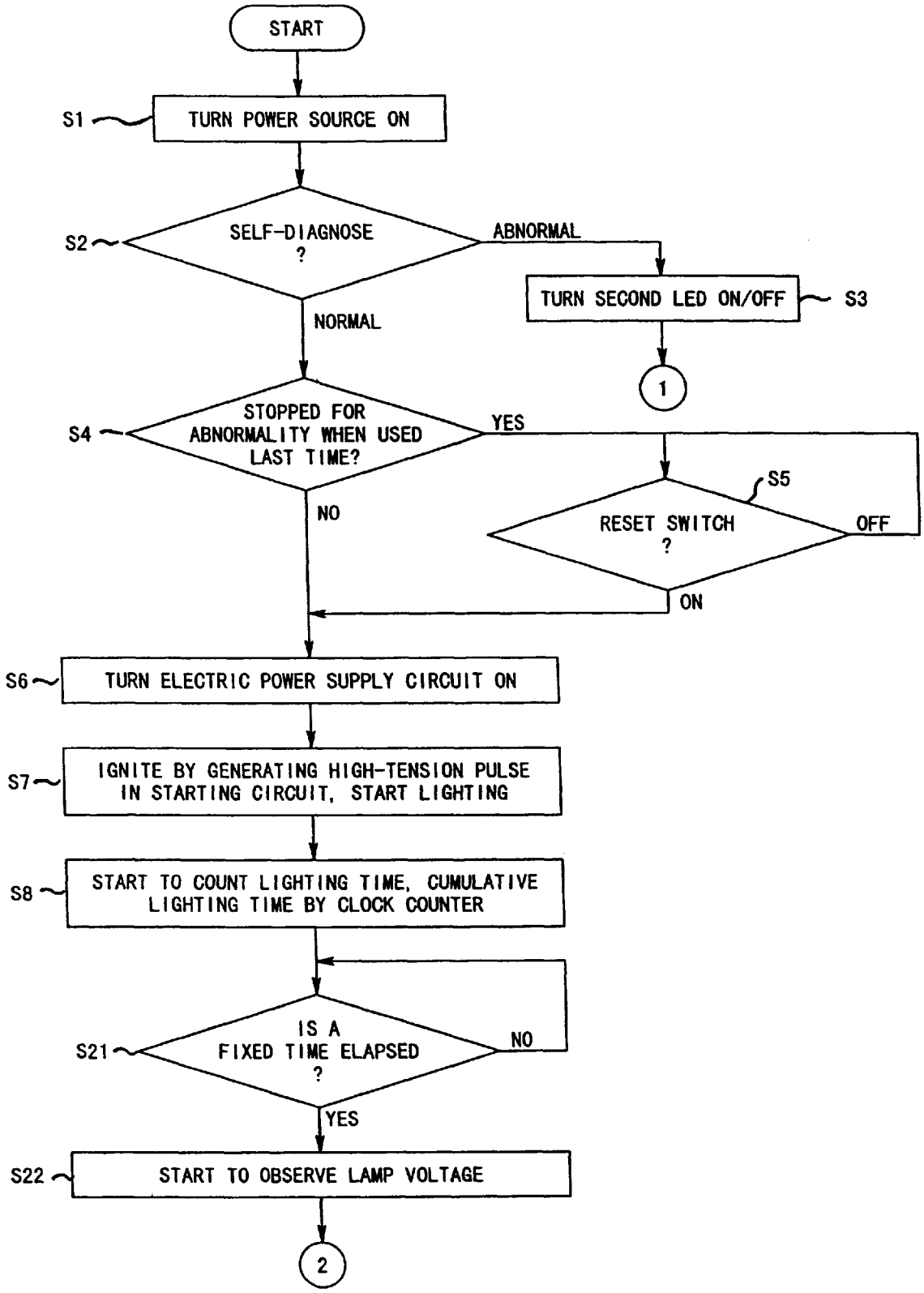
FIG. 10 and FIG. 11 are flowcharts for explaining the operation of a first deformed example in the third embodiment.

Now, centering around different points from the third embodiment, the operation of the lighting device 301 in this deformed embodiment will be described referring to the flowcharts shown in FIG. 10 and FIG. 11. In FIG. 10, Steps S1 to S8 are the same as those in the third embodiment and the detailed explanation will be omitted.

Figure 11:
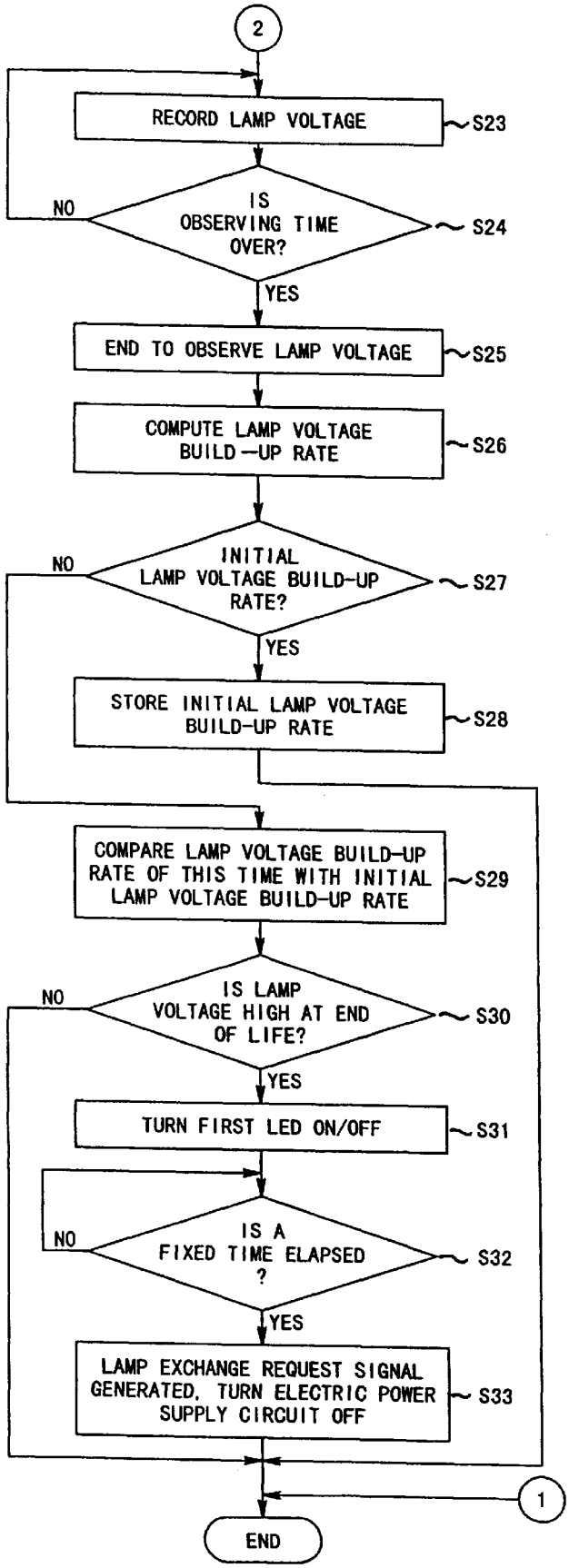

As shown in FIG. 10 and FIG. 11, after a very short time (about several seconds) after the high-pressure discharge lamp 305 is turned ON, the observation of the lamp voltage is started. Thereafter, for a certain time (about one minute after lighting the high-pressure discharge lamp 305), the lamp voltage is continuously recorded in the non-volatile memory 314 and the observation is terminated (Steps S21 to S25). From this lamp voltage record and the observation time during this period, the lamp voltage build-up rate is obtained (Step S26).

Then, it is judged whether this lamp voltage build-up rate is that at the early stage of lighting of a virgin lamp (the initial lamp voltage build-up rate) (Step S27). That is, if the reset operation was made by the reset switch 317 (Step S5) when driving the lighting device 301 this time, the lamp voltage build-up rate obtained this time is that of a virgin lamp and this value is stored in the non-volatile memory 314 as an initial lamp voltage build-up rate (Step S28). Otherwise, the high-pressure discharge lamp 305 is not a virgin lamp and as the initial lamp voltage build-up rate obtained in the previous lamp lighting was stored in the non-volatile memory 314, this initial lamp voltage build-up rate is read out and compared with the initial lamp voltage build-up rate obtained this time (Step S29).

Then, by this comparison, it is judged whether the lamp voltage is high or not at the end of life of the lamp (Step S30). That is, as the glass tube of a high-pressure discharge lamp becomes black according to its using time, the radiant quantities of infrared rays from the glass tube surface decreases. Accordingly, heat generated from the lamp itself is confined in the tube and a temperature rise rate becomes larger than a virgin lamp. Lamp temperature and lamp voltage relate closely to the gas pressure in a lamp and if a temperature rise rate is large, a lamp voltage built-up rate also becomes large.

Figure 14:
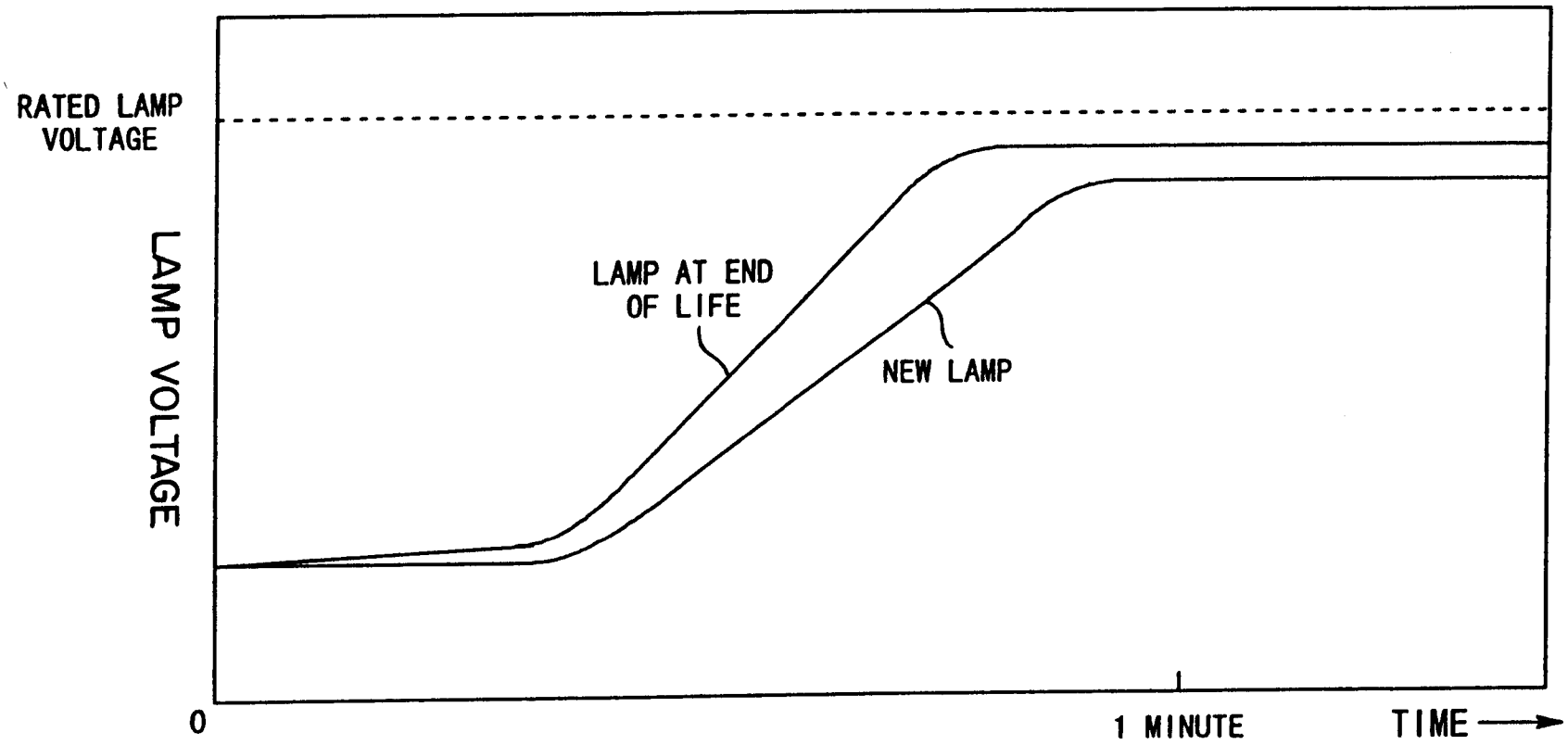
FIG. 14 is a graph showing voltage build-up rates a newly produced high-pressure discharge lamp and a discharge lamp at the end of its life.

So, when the lamp voltage build-up rate of this time is compared with the initial lamp voltage build-up rate when the same lamp was a virgin lamp, the blackening state of the high-pressure discharge lamp 305 can be estimated. FIG. 14 shows a difference between a lamp voltage build-up rate of such a new lamp and that at the early stage of lighting a lamp at the end of its life. As clearly seen from FIG. 14, a sudden change when the high-pressure discharge lamp is turned ON is taken place in several seconds to 1, 2 minutes after the lamp is turned ON. So, when the lamp voltage build-up rate of this time exceeds an initial lamp voltage build-up rate by more than a fixed value (the CPU of the microcomputer 313 obtains from an initial lamp voltage build-up rate and stores in the non-volatile memory 314), the lamp can be judged to be at the end of its life.

Then, when a high-pressure discharge lamp is judged to be at the end of its life, it is possible to inform user of the life of a lamp by turning the first LED display 316 ON and OFF faster than the third embodiment (Step S31). For instance, when the high-pressure discharge lamp 305 is used as a back light of a display, it is possible to display a lamp life and others on that display to inform user instead of using the first LED display 316.

Then, if the high-pressure discharge lamp 305 is kept ON continuously even after a certain time passed after it was turned ON (Step S32), such a signal "Lamp Exchange Request" is generated and the second LED display 318 is turned ON. At the same time, by putting out the lamp by force by lights out the electric power supply circuit 303 (Step S33), the high-pressure discharge lamp 305 is prevented from being damaged due to the end of its life.

Next, a second modified embodiment will be explained. In this second modified embodiment, when lighting the high-pressure discharge lamp again after turned it off, it is possible to light the lamp again by indirectly detecting a temperature of the high-pressure discharge lamp without depending on a thermistor and without giving useless pulses after the lamp temperature drops until it becomes possible to light the lamp again easily.

The lighting device in this second modified embodiment is in the same structure as that in the third embodiment and therefore, the detailed explanation will be omitted.

Figure 12:
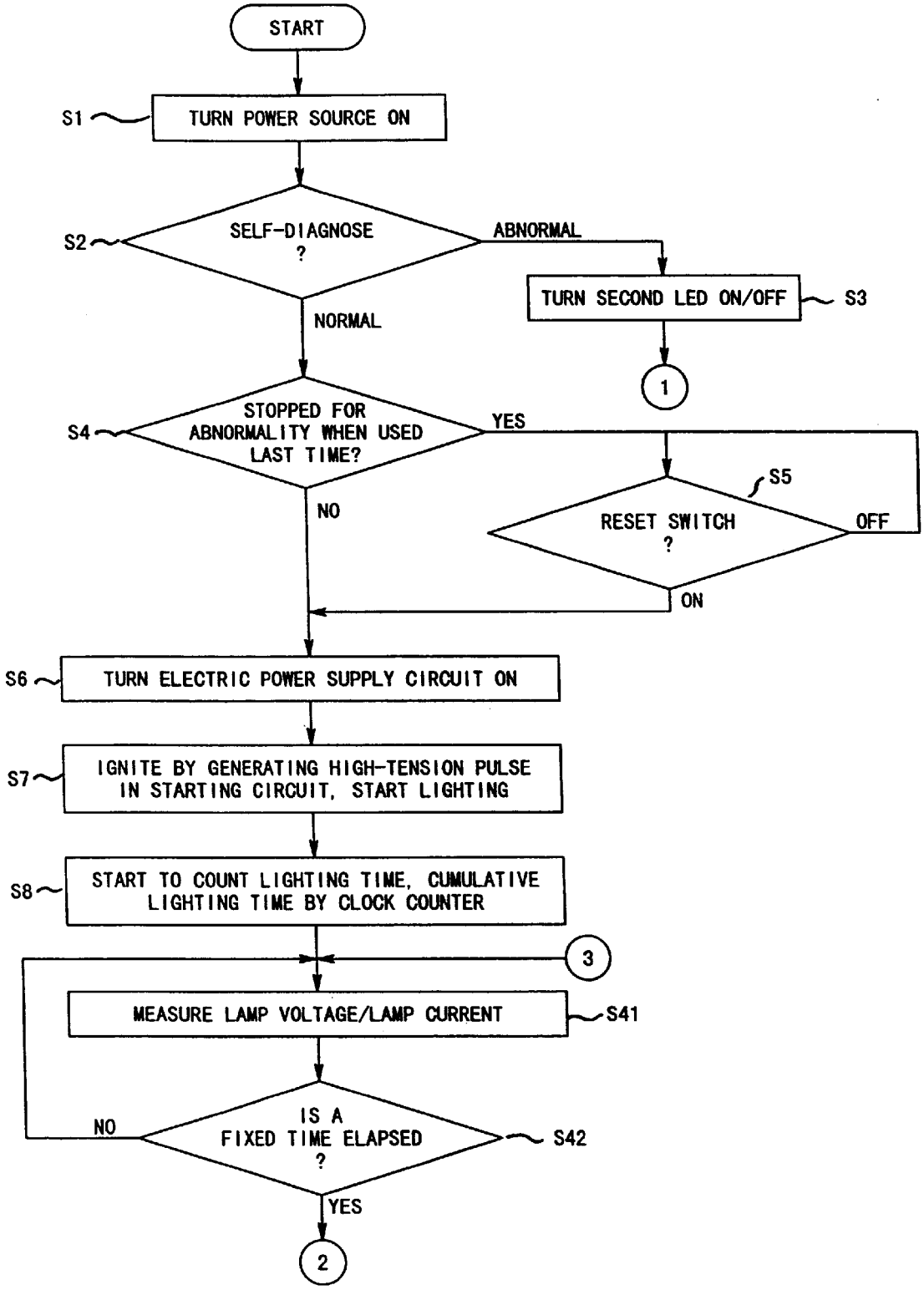
FIG. 12 and FIG. 13 are flowcharts for explaining the operation of a second deformed example in the third embodiment.

So, centering around points differing from the third embodiment, the operation of the lighting device 301 in this second modified embodiment will be explained referring the flowcharts shown in FIG. 12 and FIG. 13. In FIG. 12, the detailed explanations of Steps S1 to S8 will be omitted as they are the same as those in the third embodiment.

Figure 13:
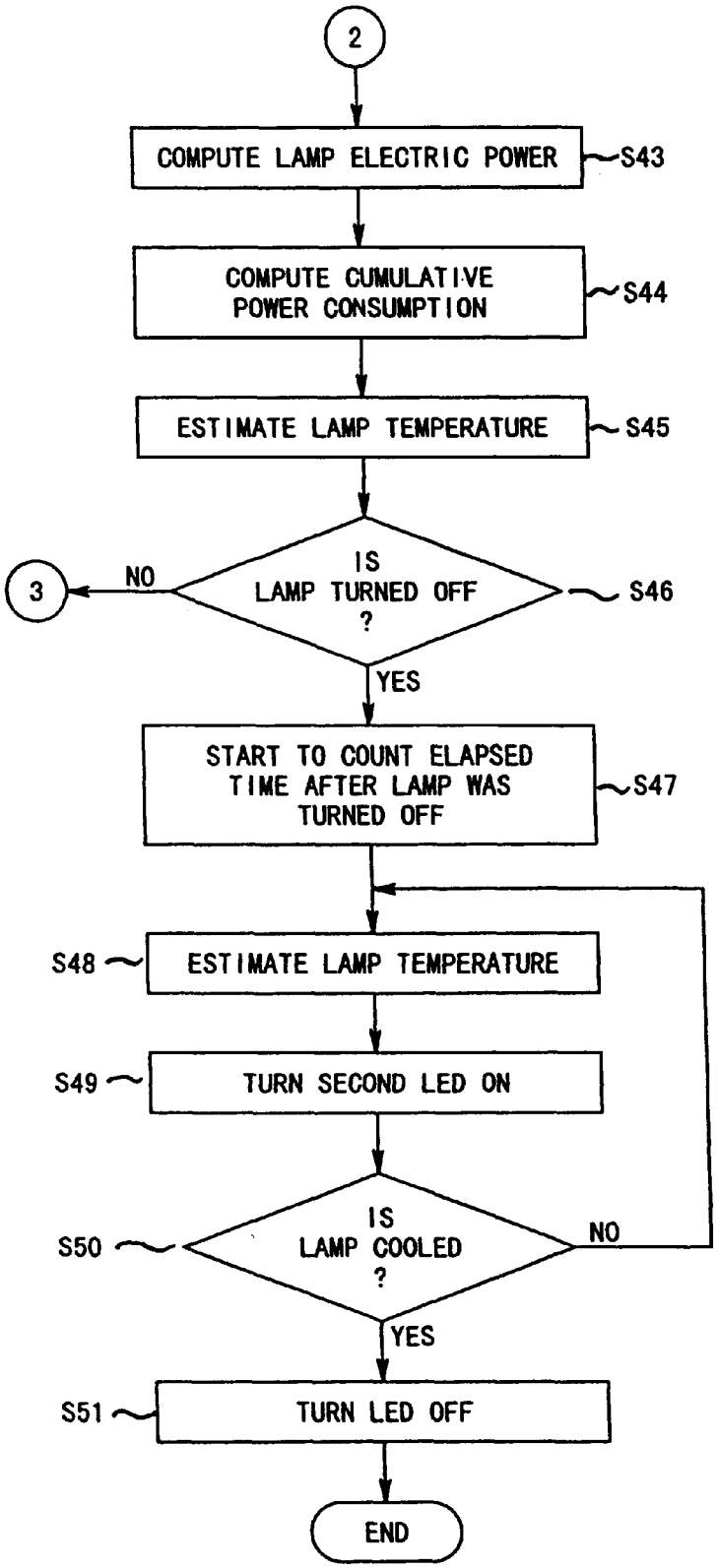

As shown in FIG. 12 and FIG. 13, after starting to light the high-pressure discharge lamp 305 (Step S7), the lamp voltage and current are measured for a preset fixed time (for instance, about 20 minutes) (Steps S41 and S42), the consumed lamp electric power is computed (Step S43). By integrating this lamp electric power, a cumulative power consumption is obtained (Step S44) and an estimated value of a current lamp temperature from the relation of lamp power, cumulative power consumption and lamp temperature obtained experimentally in advance (stored in advance as a table in ROM of the microcomputer 313) (Step S45). By repeating the above steps S41 to S45 until the lamp is turned OFF (Step S46), an estimated value of lamp temperature at the time when the lamp was put out is stored in the non-volatile memory 314. Then, the counting of an elapsed time after putting out the lamp by the clock counter 315 is started (Step S47).

Then, from the relation of the estimated value of lamp temperature immediately after it was turned off with the lamp temperature and the elapsed time experimentally obtained in advance (stored in advance in ROM of the microcomputer 313), a current lamp temperature is estimated (Step S48) and the second LED display 318 is kept ON until the lamp is cooled down to a temperature where it becomes easy to light the high-pressure discharge lamp 305 again. When the second LED display 318 is turned ON, the "STANDBY" or "CAREFUL FOR HIGH TEMPERATURE" is displayed. Then, when the temperature of the high-pressure discharge lamp 305 drops to a level where it is easily lighted, the second LED display 318 is turned OFF and the process is terminated (Steps S49, S50 and S51).

Further, in the second deformed embodiment, instead of Steps S48 to S51, it may be tried to start the high-pressure discharge lamp 305 by applying starting pulses for several minutes that are decided by a lamp temperature at an interval of a certain time (for instance, 30 seconds) until the lamp is cooled. It is desirable to set this number of pulses much when the lamp temperature is high and less when the lamp temperature is low.

In the second deformed embodiment, instead of Steps S48 to S51, an abnormality may be indicated when cooling the lamp. That is, if the high-pressure discharge lamp does not light when tried to start it by a specified number of times (for instance, 3 times) after an estimated lamp temperature dropped, regarding it abnormal, stop the operation, turn off the electric power supply circuit 303 and inform the abnormality by turning the second LED display 318 ON/OFF.

In the second deformed embodiment, a lamp temperature was estimated based on a cumulative value of electric power but a cumulative value of lamp current or lamp voltage may be used for a cumulative value of electric power although it lacks accuracy. This is because the supply power to the high-pressure discharge lamp 305 is so controlled that it is kept constant. Thus, as only one detecting circuit is sufficient for detecting the lamp current and lamp voltage only, an apparatus can be downsized.

Similarly, although lacking accuracy, it is possible to estimate a lamp temperature referring to a table registered in the ROM of the microcomputer from only the secular change after the lamp was turned ON/OFF. In this case, circuits for detecting lamp voltage and lamp current become unnecessary.

What is claimed is:

1. A discharge lamp lighting apparatus comprising:

a power source to supply an electric power to a discharge lamp via a supply line;

switching means for turning on/off a line current flowing through the supply line;

PWM control means for PWM controlling the electric power by controlling on/off timing of the switching means;

line voltage detecting means for detecting a line voltage generated on the supply line;

line current detecting means for detecting the line current flowing through the supply line;

electric power detecting means for detecting an input power to the discharge lamp based on the detected values of the line voltage and line current;

constant power control means for maintaining the supplied power to the discharge lamp at a constant level by controlling the PWM controlling means, the controlling based on the detected input power and a preset ON time ratio (duty ratio) of the switching means;

lamp voltage detecting means for determining the voltage of the discharge lamp according to an equation (1) shown below based on the detected supply line voltage; and turning off means for turning off the discharge lamp when the determined discharge lamp voltage fails to match a preset range for a fixed amount of time;

Discharge lamp voltage=Supply line voltage value×ON time ratio duty) of pulse current supplied to the discharge lamp by PWM control (1).

2. A discharge lamp lighting apparatus comprising:

a power source to supply an electric power to a discharge lamp via a supply line;

switching means for turning on/off a line current flowing through the supply line;

PWM control means for PWM controlling the electric power by controlling on/off timing of the switching means;

line voltage detecting means for detecting a line voltage generated on the supply line;

line current detecting means for detecting the line current flowing through the supply line;

electric power detecting means for detecting an input power to the discharge lamp based on the detected values of the line voltage and line current;

constant power control means for maintaining the supplied power to the discharge lamp at a constant level by controlling the PWM controlling means, the controlling based on the detected input power and a preset ON time ratio (duty ratio) of the switching means;

lamp voltage detecting means for determining the voltage of the discharge lamp according to an equation (2) shown below based on the detected supply line voltage; and turning off means for turning off the discharge lamp when the determined discharge lamp voltage fails to match a preset range for a fixed amount of time;

Discharge lamp voltage=Supply line voltage value×ON time ratio (duty ratio) of pulse current supplied to the discharge lamp by said PWM control×Correction factor relative to the supply line voltage.

3. A discharge lamp lighting apparatus comprising:

a power source to supply an electric power to a discharge lamp via a supply line;

switching means for turning on/off a line current flowing through the supply line;

PWM control means for PWM controlling the electric power by controlling on/off timing of the switching means;

line voltage detecting means for detecting a line voltage generated on the supply line;

line current detecting means for detecting the line current flowing through the supply line;

electric power detecting means for detecting an input power to the discharge lamp based on the detected values of the line voltage and line current;

constant power control means for maintaining the supplied power to the discharge lamp at a constant level by controlling the PWM controlling means, the controlling based on the detected input power and a preset ON time ratio (duty ratio) of the switching means;

lamp voltage detecting means for determining the voltage of the discharge lamp according to an equation (3) shown below based on the detected supply line voltage; and turning off means for turning off the discharge lamp when the determined discharge lamp voltage fails to match a preset range for a fixed amount of time;

Discharge lamp voltage=F (x, y) (3)

(In the equation (3), F (x, y) is a function with variables x and y, x is a voltage value of the supply line and y is ON time ratio (duty ratio) of the pulse current supplied to the discharge lamp).

4. A discharge lamp lighting apparatus according to any one of claims 1 to 3, wherein, the electric power detecting means, the constant power control means and the turning off means are incorporated in a single microcomputer which operates according to a prescribed program and this microcomputer puts out the light of the discharge lamp by making into zero (0) the ON time of the switching means through the PWM control.

5. A discharge lamp lighting apparatus according to claim 4, wherein the microcomputer comprises:

a low-frequency amplifier to amplify a relatively low frequency change component from a detected analog signal, the detected analog signal being output by the line current detecting means;

a high-frequency amplifier to amplify a higher frequency change component than the low-frequency change component from the detected analog signal thereby producing an amplified high-frequency signal;

a D/A converter to D/A convert the digital control signal output by the microcomputer; and an amplifier to amplify the analog signal after the D/A conversion by reducing or adding output signal of the high-frequency amplifier and output to the PWM control means;

wherein the microcomputer detects the supply power to the discharge lamp based on the output signal of the low-frequency amplifier and the output signal of the line voltage detecting signal.

6. A discharge lamp lighting apparatus comprising:

a discharge lamp;

a lighting circuit to light the discharge lamp;

a voltage sensor to detect the lamp voltage of the discharge lamp;

first comparing means for comparing the lamp voltage detected by the voltage sensor with a first threshold value lower than a prescribed rated voltage of the discharge lamp and a second threshold value that is further lower than the first threshold value;

first stopping means for putting out the lighting circuit when the comparison by the first comparing means revealed that the lamp voltage became below the second threshold value;

first clocking means for counting a continued time when the comparison by the first comparing means revealed that the lamp voltage became a value between the first and the second threshold values; and second stopping means for putting out the lighting circuit when the continued time counted by the first clocking means elapsed a prescribed period of time.

7. A discharge lamp lighting apparatus according to claim 6, further comprising:

an igniter to start the discharge lamp; and third stopping means for putting out the starting circuit when the comparison by the first comparing means revealed that the lamp voltage became below the first threshold value.

8. A discharge lamp lighting apparatus according to claim 7, further comprising:

second comparing means for comparing the detected value of lamp voltage with a third threshold value larger than a prescribed rated voltage of the discharge lamp;

second clocking means for counting a continued time when the comparison by the second comparing means revealed that the lamp voltage becomes above the third threshold value; and fourth stopping means for putting out the lighting circuit and the igniter when the continued time counted by the second clocking means elapsed a prescribed period of time.

9. A discharge lamp lighting apparatus according to any one of claims 6 to 8, further comprising:

announcing means for announcing the stop of the lighting circuit when it is put out by the first, second or fourth stopping means.

10. A discharge lamp lighting apparatus according to any one of claims 6 to 8, further comprising:

latching means for retaining either the lighting circuit or the igniter in the stopped state until the power source is turned on again or the lamp lighting signal is input again when at least either the lighting circuit or the igniter was stopped by the first, second, third or fourth stopping means.

11. A discharge lamp lighting apparatus comprising:

initial lamp voltage storage means for storing an initial lamp voltage when a discharge lamp is initially lighted;

voltage detecting means for detecting the lamp voltage while the discharge lamp is on;

voltage comparing means for comparing the lamp voltage detected by the voltage detecting means with the initial lamp voltage stored in the initial lamp voltage storage means; and lamp life detecting means for detecting the life of a discharge lamp based on the result of comparison by the voltage comparing means.

12. A discharge lamp lighting apparatus comprising:

lamp voltage build-up rate storage means for storing a voltage build-up rate at the initial stage when initially lighting a discharge lamp;

voltage build-up rate detecting means for detecting a lamp voltage build-up rate after lighting the discharge lamp;

voltage build-up rate comparing means for comparing the initial lamp voltage build-up rate stored in the lamp voltage build-up rate storage means with the voltage build-up rate after lighting that was detected by the voltage build-up rate detecting means; and life detecting means for detecting the life of the discharge lamp based on the result of comparison by the voltage build-up rate comparing means.

13. A discharge lamp lighting apparatus according to claim 12, wherein the life detecting means detects a lamp life when the lamp voltage build-up rate detected by the voltage build-up rate detecting means exceeds the initial lamp voltage build-up rate stored in the lamp voltage build-up storage means by a fixed value.

14. A discharge lamp lighting apparatus according to any one of claims 11 to 13, further comprising:

first announcing means for announcing the life of a discharge lamp detected by the life detecting means.

15. A discharge lamp lighting apparatus according to claim 14, further comprising:

clocking means for counting the lighting time of the discharge lamp after starting the announce by the first announcing means;

judging means for judging whether the lighting time measured by the clocking means exceeds a prescribed time; and second announcing means for announcing to urge the exchange of the discharge lamp when the discharge lamp was judged by the judging means that the lighting time exceeded the prescribed time.

16. A discharge lamp lighting apparatus comprising:

voltage detecting means for detecting the lamp voltage of a discharge lamp;

current detecting means for detecting the lamp current of the discharge lamp;

power consumption computing means for computing power consumption of the discharge lamp from the lamp voltage detected by the voltage detecting means and the lamp current detected by the current detecting means;

temperature estimating means for estimating a temperature of the discharge lamp based on the power consumption computed by the power consumption computing means; and judging means for judging required conditions for the next re-lighting of the discharge lamp from the temperature estimated by the temperature estimating means.

17. A discharge lamp lighting apparatus for lighting a discharge lamp while controlling supply power so as to maintain the supply power at a desired fixed value, comprising:

voltage detecting means for detecting a lamp voltage of the discharge lamp;

temperature estimating means for estimating a temperature of the discharge lamp based on the lamp voltage detected by the voltage detecting means; and judging means for judging required conditions for the next re-lighting of the discharge lamp from the temperature estimated by the temperature estimating means.

18. A discharge lamp lighting apparatus according to claim 17, further comprising:

clocking means for counting a lapse time from the turning off the discharge lamp;

wherein the temperature estimating means estimates the discharge lamp temperature based on the elapsed time counted by the clocking means and the lamp voltage detected by the voltage detecting means.

19. A discharge lamp lighting apparatus to light a discharge lamp while controlling supply power at a desired fixed value, comprising:

current detecting means for detecting a lamp current of the discharge lamp;

temperature estimating means for estimating a temperature of the discharge lamp based on the lamp current detected by the current detecting means; and judging means for judging required conditions for the next re-lighting of the discharge lamp from the temperature estimated by the temperature estimating means.

20. A discharge lamp lighting apparatus according to claim 16 or 17, further comprising:

clocking means for counting an elapsed time from the turning off the discharge lamp;

lighting time detecting means for judging a time until the discharge lamp is cooled to a proper temperature sufficient to re-light the discharge lamp next based on the time counted by the clocking means and the temperature estimated by the temperature estimating means; and announcing means for announcing that the discharge lamp is not in the state proper to light it again until the time detected by the lighting time detecting means after the lamp was put out.

21. A discharge lamp lighting apparatus according to claim 20, further comprising:

starting pulse applying means for applying starting pulse one time or a plurality of times to the discharge lamp in the period till a time when the discharge lamp is cooled down to a temperature proper to light it again next after the lamp was put out.

* * * * *